US009761427B2

(12) United States Patent
Wouters et al.

(10) Patent No.: US 9,761,427 B2
(45) Date of Patent: Sep. 12, 2017

(54) SYSTEM FOR TRANSFERRING IONS IN A MASS SPECTROMETER

(71) Applicant: Thermo Finnigan LLC, San Jose, CA (US)

(72) Inventors: Eloy R. Wouters, San Jose, CA (US); Satendra Prasad, San Jose, CA (US); Jean-Jacques Dunyach, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/139,939

(22) Filed: Apr. 27, 2016

(65) Prior Publication Data

US 2016/0322209 A1 Nov. 3, 2016

Related U.S. Application Data

(60) Provisional application No. 62/154,557, filed on Apr. 29, 2015.

(51) Int. Cl.
*H01J 49/06* (2006.01)

(52) U.S. Cl.
CPC ..... *H01J 49/066* (2013.01)

(58) Field of Classification Search
USPC ..... 250/282
See application file for complete search history.

(56) References Cited

U.S. PATENT DOCUMENTS 4,542,293 A 9/1985 Fenn et al.
4,977,320 A 12/1990 Chowdhury et al.
5,736,740 A 4/1998 Franzen
5,965,883 A 10/1999 Lee et al.
6,107,628 A 8/2000 Smith et al.
6,455,846 B1 9/2002 Prior et al.
6,583,408 B2 6/2003 Smith et al.
6,703,611 B2 3/2004 Glish et al.
6,943,347 B1 9/2005 Willoughby et al.
7,081,620 B2 7/2006 Kato
7,741,600 B2 * 6/2010 Wouters ..... H01J 49/044 250/281
7,781,728 B2 8/2010 Senko et al.
(Continued)

OTHER PUBLICATIONS

Ibrahim et al., "improving mass Spectrometer Sensitivity Using a High-Pressure Electrodynamic Ion Funnel Interface", J Am Soc Mass Spectrom 2006, 17, pp. 1299-1305.

*Primary Examiner* — Phillip A Johnston
(74) *Attorney, Agent, or Firm* — Thomas F. Cooney

(57) ABSTRACT

A system for transporting ions includes: an ion transfer tube having an axis and an internal bore having a width and a height less than the width; and an apparatus comprising a plurality of electrodes, each having a respective ion aperture having an aperture center, the apertures defining an ion channel configured to receive the ions from the ion transfer tube and to transport the ions to an outlet end of the apparatus, wherein at least a subset of the apertures progressively decrease in size in a direction towards the apparatus outlet end, wherein the ion transfer tube is configured such that the ion transfer tube axis is non-coincident with an axis of the ion channel or such that the width dimension of the ion transfer tube bore is parallel to a plane defined by the ion transfer tube axis and the ion channel axis.

11 Claims, 22 Drawing Sheets

(56) References Cited

U.S. PATENT DOCUMENTS

| | | | | |
|---|---|---|---|---|
| 8,309,916 | B2 * | 11/2012 | Wouters | H01J 49/0404 250/281 |
| 8,907,272 | B1 * | 12/2014 | Wouters | H01J 49/066 250/281 |
| 2002/0096630 | A1 | 7/2002 | Russ, IV | |
| 2002/0175281 | A1 | 11/2002 | Valaskovic | |
| 2002/0185595 | A1 | 12/2002 | Smith et al. | |
| 2003/0052269 | A1 | 3/2003 | Apffel et al. | |
| 2003/0168591 | A1 | 9/2003 | Smith et al. | |
| 2004/0129876 | A1 | 7/2004 | Franzen | |
| 2004/0245458 | A1 | 12/2004 | Sheehan et al. | |
| 2006/0076485 | A1 | 4/2006 | Stoermer et al. | |
| 2006/0186329 | A1 | 8/2006 | Gebhardt et al. | |
| 2007/0200059 | A1 | 8/2007 | Tang et al. | |
| 2007/0278399 | A1 | 12/2007 | Kim et al. | |
| 2008/0073555 | A1 | 3/2008 | Dunyach et al. | |
| 2008/0116371 | A1 | 5/2008 | Wouters et al. | |
| 2008/0142698 | A1 | 6/2008 | Atherton et al. | |
| 2008/0296493 | A1 | 12/2008 | Willoughby et al. | |
| 2008/0308721 | A1 | 12/2008 | Senko et al. | |
| 2009/0050801 | A1 | 2/2009 | Fedorov | |
| 2009/0057551 | A1 | 3/2009 | Tang et al. | |
| 2011/0049357 | A1 | 3/2011 | Giles | |
| 2013/0120894 | A1 | 5/2013 | Van Amerom et al. | |
| 2013/0175440 | A1 | 7/2013 | Perelman et al. | |

* cited by examiner

SYSTEM FOR TRANSFERRING IONS IN A MASS SPECTROMETER

CROSS REFERENCE TO RELATED APPLICATION

This application claims, under 35 U.S.C. §119(e), the benefit of the filing date of commonly-owned U.S. Provisional Application for Patent No. 62/154,557, filed on Apr. 29, 2015 and titled "System for Transferring Ions in a Mass Spectrometer," said Provisional Application hereby incorporated by reference herein in its entirety.

FIELD OF THE INVENTION

The present invention relates generally to ion optics for mass spectrometers, and more particularly to a system for transferring ions from one or more atmospheric-pressure or near-atmospheric-pressure ion sources to an evacuated or lower-pressure region.

BACKGROUND OF THE INVENTION

Mass spectrometry analysis techniques are generally carried out under conditions of high vacuum. However, various types of ion sources used to generate ions for MS analyses operate at or near atmospheric pressures. Thus, those skilled in the art are continually confronted with challenges associated with transporting ions and other charged particles generated at atmospheric or near atmospheric pressures, and in many cases contained within a large gas flow, into regions maintained under high vacuum.

Most mass spectrometers with an Atmospheric Pressure Ion (API) source are equipped with a small bore capillary (often referred to as an "ion transfer tube") to limit gas conductance for good vacuum inside the instrument and proper functioning of the mass analyzer. But limiting gas conductance also severely restricts ion sampling from the API source into the mass spectrometer and limits the overall sensitivity of the mass spectrometer (Bruins, A. P., "Mass spectrometry with ion sources operating at atmospheric pressure", *Mass Spectrom. Rev.,* 1991, 10(1), pp. 53-77). One approach that has been employed to alleviate the restriction has been to increase the conductance of the capillary (frequently by increasing the capillary diameter, D) so as to allow more ions into the mass spectrometer. Unfortunately, an increase in the conductance can render the vacuum inside the mass spectrometer unsuitable for mass analysis. This result is implied in the Hagen-Poiseuille derivation that relates conductance to a capillary D as described below:

$$C = 180\left(\frac{D^4}{L}\right)P_{av}. \qquad \text{Eq. 1}$$

where the length, L, is in centimeters and the average pressure ($P_{av}$) is in Torr (Moore, J. H.; Davis, C. C.; and Coplan, M. A., *Building Scientific Instruments,* 4th ed.; Cambridge University Press: New York, USA, 2009). The dependence of C on the fourth power of the diameter, D, implies that a subtle increase in conductance will yield excessive gas load for the vacuum pumps. This has been a developmental bottleneck that defines, in part, the sensitivity of a mass spectrometer. Efforts over the last decade have trended towards increasing the inlet gas throughput, Q, and developing ways to handle the complications that arise from high Q, such as increasing vacuum pumping capacity.

Various approaches have been proposed in the mass spectrometry art for improving ion transport efficiency into low vacuum regions. For example, FIGS. 1A-1B are two schematic depictions of mass spectrometer systems 1-2 which utilize an ion transport apparatus to so as to deliver ions generated at near atmospheric pressure to a mass analyzer operating under high vacuum conditions. As one example, analyte ions may be formed by the electrospray (ESI) technique by introducing a sample comprising a plume 9 of charged ions and droplets into an ionization chamber 7. In the illustrated example, ions are generated via an electrospray needle 10. For an ion source that utilizes the electrospray technique, ionization chamber 7 will generally be maintained at or near atmospheric pressure. Although an electrospray ion source is illustrated, the ion source may comprise any other conventional continuous or pulsed atmospheric pressure ion source, such as a thermal spray source, an APCI source or a MALDI source.

In the systems 1-2 illustrated in FIGS. 1A-1B, the analyte ions, together with background gas and possibly partially desolvated droplets, flow into the inlet end of a conventional ion transfer tube 15 (e.g., a narrow-bore capillary tube) and traverse the length of the tube under the influence of a pressure gradient. Analyte ion transfer tube 15 is preferably held in good thermal contact with a heating block 12. The analyte ions emerge from the outlet end of ion transfer tube 15, which opens to an entrance 27 of an ion transport device 5 located within a first low vacuum chamber 13. As indicated by the arrow on vacuum port 31, chamber 13 is evacuated to a low vacuum pressure by, for example, a mechanical pump or equivalent. Under typical operating conditions, the pressure within the low vacuum chamber 13 will be in the range of 1-10 Torr (approximately 1-10 millibar), but it is believed that the ion transport device 5 may be successfully operated over a broad range of low vacuum and near-atmospheric pressures, e.g., between 0.1 millibar and 1 bar.

After being constricted into a narrow beam by the ion transport device 5, the ions are directed through aperture 22 of extraction lens 14 so as to exit the first low pressure chamber 13 and enter into an ion accumulator 36, which is likewise evacuated, but to a lower pressure than the pressure in the first low pressure chamber 13, also by a second vacuum port 35. The ion accumulator 36 functions to accumulate ions derived from the ions generated by ion source 10. The ion accumulator 36 can be, for example, in the form of a multipole ion guide, such as an RF quadrupole ion trap or a RF linear multipole ion trap. Where ion accumulator 36 is an RF quadrupole ion trap, the range and efficiency of the ion mass-to-charge ratios captured in the RF quadrupole ion trap may be controlled by, for example, selecting the RF and DC voltages used to generate the quadrupole field, or applying supplementary fields, e.g. broadband waveforms. A collision or damping gas such as helium, nitrogen, or argon, for example, can be introduced via inlet 23 into the ion accumulator 36. The neutral gas provides for stabilization of the ions accumulated in the ion accumulator and can provide target molecules for collisions with ions so as to cause collision-induced fragmentation of the ions, when desired.

The ion accumulator 36 may be configured to radially eject the accumulated ions towards an ion detector 37, which is electronically coupled to an associated electronics/processing unit 24. The ion accumulator 36 may alternatively be configured to eject ions axially so as to be detected by ion detector 34. The detector 37 (or detector 34) detects the ejected ions. Sample detector 37 (or detector 34) can be any conventional detector that can be used to detect ions ejected from ion accumulator 36.

Ion accumulator 36 may also be configured, as shown in FIG. 1B, to eject ions axially towards a subsequent mass analyzer 45 through aperture 28 (optionally passing through ion transfer optics which are not shown) where the ions can be analyzed. The ions are detected by the ion detector 47 and its associated electronics/processing unit 44. The mass analyzer 45 may comprise an RF quadrupole ion trap mass analyzer, a Fourier-transform ion cyclotron resonance (FT-ICR) mass analyzer, an Orbitrap™ electrostatic-trap type mass analyzer or other type of electrostatic trap mass analyzer or a time-of-flight (TOF) mass analyzer. If the mass analyzer 45 is an Orbitrap™ electrostatic-trap type mass analyzer, then the ions ejected from the accumulator 36 may be ejected radially to the mass analyzer instead of axially. The analyzer is housed within a high vacuum chamber 46 that is evacuated by vacuum port 43. In alternative configurations, ions that are ejected axially from the ion accumulator 36 may be detected directly by an ion detector (47) within the high vacuum chamber 46. As one non-limiting example, the mass analyzer 45 may comprise a quadrupole mass filter which is operated so as to transmit ions that are axially ejected from the ion accumulator 36 through to the detector 47.

FIGS. 1A-1B illustrate two particular examples of mass spectrometer systems in which ion transport devices may be used to deliver ions from an atmospheric or near-atmospheric ion source into a vacuum chamber. Such ion transport devices may be of various types including, for example, the ion transport device illustrated in FIG. 2A, the well-known ion funnel devices (discussed further in the following in reference to FIG. 3), the ion transport apparatuses disclosed herein and discussed below in reference to FIGS. 5A-5C, 6, 7 and 8A as well as other types. All these ion transport devices may be generally employed in other types of mass spectrometer systems in addition to the systems shown in FIGS. 1A-1B. For example, whereas the systems of FIGS. 1A-1B include an ion accumulator or ion trap (36), other mass spectrometer systems, such as triple-quadrupole mass spectrometer systems, may similarly advantageously employ such ion transport devices (as are known in the art or as described in the present teachings). Instead of employing an ion accumulator or ion trap mass analyzer, triple quadrupole systems (not specifically illustrated in the drawings) instead generally employ a sequence of quadrupole apparatuses comprising: a quadrupole mass filter (Q1), an RF-only quadrupole collision cell (Q2) and a second quadrupole mass filter (Q3). As with the systems illustrated in FIGS. 1A-1B, these mass analyzer components reside in one or more evacuated chambers and, thus, an ion transport apparatus and system as disclosed herein may be advantageously employed if ions are generated in an atmospheric or near-atmospheric ion source.

FIG. 2A depicts (in rough cross-sectional view) details of an example of an ion transport device 5 as taught in U.S. Pat. No. 7,781,728, which is assigned to the assignee of the instant invention and is hereby incorporated by reference herein in its entirety. Ion transport device 5 is formed from a plurality of generally planar electrodes 38, comprising a set of first electrodes 16 and a set of second electrodes 20, arranged in longitudinally spaced-apart relation (as used herein, the term "longitudinally" denotes the axis defined by the overall movement of ions along ion channel 32). Devices of this general construction are sometimes referred to in the mass spectrometry art as "stacked-ring" ion guides. An individual electrode 38 is illustrated in FIG. 2B. FIG. 2B illustrates that each electrode 38 is adapted with an aperture 33 through which ions may pass. The apertures collectively define an ion channel 32 (see FIG. 2A), which may be straight or curved, depending on the lateral alignment of the apertures. To improve manufacturability and reduce cost, all of the electrodes 38 may have identically sized apertures 33. An oscillatory (e.g., radio-frequency) voltage source 42 applies oscillatory voltages to electrodes 38 to thereby generate a field that radially confines ions within the ion channel 32. Preferably, each electrode 38 receives an oscillatory voltage that is equal in amplitude and frequency but opposite in phase to the oscillatory voltage applied to the adjacent electrodes. As depicted, electrodes 38 may be divided into a plurality of first electrodes 16 interleaved with a plurality of second electrodes 20, with the first electrodes 16 receiving an oscillatory voltage that is opposite in phase with respect to the oscillatory voltage applied to the second electrodes 20. In this regard, note that the first electrodes 16 and the second electrodes 20 are respectively electrically connected to opposite terminals of the oscillatory voltage source 42. In a typical implementation, the frequency and amplitude of the applied oscillatory voltages are 0.5-3 MHz and 50-400 $V_{p-p}$ (peak-to-peak), the required amplitude being strongly dependent on frequency.

To create a tapered electric field that focuses the ions to a narrow beam proximate the exit 39 of the ion transport device 5, the longitudinal spacing of electrodes 38 may increase in the direction of ion travel. It is known in the art (see, e.g., U.S. Pat. No. 5,572,035 to Franzen) that the radial penetration of an oscillatory field in a stacked ring ion guide is proportional to the inter-electrode spacing. Near entrance 27, electrodes 38 are relatively closely spaced, which provides limited radial field penetration, thereby producing a wide field-free region around the longitudinal axis. This condition promotes high efficiency of acceptance of ions flowing from the ion transfer tube 15 into the ion channel 32. Furthermore, the close spacing of electrodes near entrance 27 produces a strongly reflective surface and shallow pseudo-potential wells that do not trap ions of a diffuse ion cloud. In contrast, electrodes 38 positioned near exit 39 are relatively widely spaced, which provides effective focusing of ions (due to the greater radial oscillatory field penetration and narrowing of the field-free region) to the central longitudinal axis. A longitudinal DC field may be created within the ion channel 32 by providing a DC voltage source 41 that applies a set of DC voltages to electrodes 38.

In an alternative embodiment of an ion transport device, the electrodes may be regularly spaced along the longitudinal axis. To generate the tapered radial field, in such an alternative embodiment, that promotes high ion acceptance efficiency at the entrance of the ion transport device as well as tight focusing of the ion beam at the device exit, the amplitude of oscillatory voltages applied to electrodes increases in the direction of ion travel.

A second known ion transport apparatus is described in U.S. Pat. No. 6,107,628 to Smith et al. and is conventionally known as an "ion funnel". FIG. 3 provides a schematic depiction of such an ion funnel apparatus 50 in both a longitudinal cross-sectional view and end-on view as viewed along the axis 51. Roughly described, the ion funnel device consists of a multitude of closely longitudinally spaced ring electrodes, such as the four illustrated ring electrodes 52*a*-52*d*, that have apertures that decrease in size from the entrance of the device to its exit. In FIG. 3 as well as in subsequent drawings, different patterns on the representations of the various different electrodes are provided only to aid in visual distinguishing between the various electrode representations and are not intended to imply that the electrodes are necessarily formed of differing materials. The apertures are defined by the ring inner surfaces 53 and the ion entrance corresponds with the largest aperture 54, and the ion exit corresponds with the smallest aperture 55. The electrodes are electrically isolated from each other, for example, by insulator boards 57, and radio-frequency (RF) voltages are applied to the electrodes in a prescribed phase relationship to radially confine the ions to the interior of the device.

The relatively large aperture size at the entrance of the ion funnel apparatus (FIG. 3) provides for a large ion acceptance area, and the progressively reduced aperture size creates a "tapered" RF field having a field free zone that decreases in diameter along the direction of ion travel, thereby focusing ions to a narrow beam which may then be passed through the aperture of a skimmer or other electrostatic lens without incurring a large degree of ion losses. Generally, an RF voltage is applied to each of the successive ring elements so that the RF voltages of each successive element are 180 degrees out of phase with the adjacent element(s). A direct current (DC) electrical field may be created using a power supply and a resistor chain (not illustrated) to supply the desired and sufficient voltage to each element to create the desired net motion of ions down the funnel. The electrical connections to the ring electrodes as well as ancillary electronic components, such as voltage dividing resistors may be provided on the insulator boards 57 in the form of conventional printed circuits. Still further, the ring electrodes themselves may be printed components of the insulator boards 57. The boards (printed circuit substrates) may be fabricated from conventional printed circuit board material such as a cloth or fiber material—such as cotton or woven glass fibers—that is impregnated with a resin—such as epoxy.

The depiction in FIG. 3 of the ion funnel known in the art is very schematic. Practical implementations of this device often include a first portion of the device that has a plurality of spaced-apart ring electrodes 52*a* all having the same large inner diameter and a second portion of the device having the ring electrodes 52*a*-52*d*, etc. whose inner diameters taper down gradually so as to focus the ions towards the central axis and the smallest orifice at the exit end 55. The first portion is located on the side where the ions enter the device. In operation, the ion-laden gas emerging from the atmospheric pressure enters, by means of one or more orifices or, in the example shown, an ion transfer tube 15, into a first portion of the device where it emerges at high velocity and undergoes rapid gas expansion. The length of the first portion of the device provides a minimum lateral distance between the ion transfer tube 15 (or other entrance orifice or orifices or multiple ion transfer tubes) and the tapering-diameter second portion within which the forward velocity of the ion laden gas is lowered by collisions with background gas. When the forward velocity of the ion laden gas has sufficiently been lowered, it becomes possible to manipulate the ions with radio frequency electric fields with low enough amplitudes to be below the Paschen breakdown limit, and preferentially guide the ions towards the exit end 55. Refinements to and variations on the ion funnel device are described in (for example) U.S. Pat. No. 6,583,408 to Smith et al., U.S. Pat. No. 7,064,321 to Franzen, EP App. No. 1,465,234 to Bruker Daltonics, and Julian et al., "Ion Funnels for the Masses: Experiments and Simulations with a Simplified Ion Funnel", J. Amer. Soc. Mass Spec., vol. 16, pp. 1708-1712 (2005).

As noted in the foregoing discussion, various conventional mass spectrometer system designs use an ion transfer tube to transport solvent laden cluster ions and gas into a first vacuum chamber of a mass spectrometer where either an ion funnel or a stacked ring ion guide used to capture the ion cloud from the free jet expansion. As the high velocity gas enters the ion funnel or stacked ring ion guide, ions are propelled by the co-expanding gas predominantly in the forward direction and are controlled and guided by the RF field towards a central orifice at the exit end of the ion funnel or stacked ring ion guide. The inventors have observed that, as the high velocity gas impacts solid components of such ion transport apparatuses, it leaves a distinctive mark comprising a residue of contaminants that build up on certain portions of the electrodes. Over time, the continued build up of these deposited contaminants can cause electrical arcing across the closely spaced electrodes and can change the electrical permittivity of ion lenses, which in turn reduces ion transmission. As a result, mass spectrometers that employ such ion transport devices require occasional time-consuming disassembly and cleaning of these devices. The disassembly and cleaning steps caused by the impingement of gas onto the electrodes may be complicated by the presence of insulator boards 57 and their associated wires or other electronic components The robustness of ion optics has been a key factor in stimulating efforts to improve the atmospheric-vacuum interface of mass spectrometers. Earlier designs have trended towards enlarging the circular inner diameter of a mass spectrometer gas inlet (e.g., an ion transfer tube) to allow more ions into the mass spectrometer. However, the above-noted problem of deposition of neutrals on electrodes can be exacerbated when ion transfer tubes are simply increased in inner diameter in this fashion. Conventionally, the impact of this on instrument robustness has been minimized by maintaining adequate desolvation of ions across the ion transfer tube and evacuating the increased gas load.

The ion transfer tube (or capillary) 15 represents a major restriction in the flow of ions from an atmospheric pressure ion source and into a mass spectrometer. The progressive step down in pressure across multiple mass spectrometer chambers (pumping stages), as depicted in FIGS. 1A-1B and described above is vital for the proper functioning of ion optics in each chamber and for maintaining transport of ions across the multiple pumping stages. However, attempts to increase the ion flux into the mass spectrometer by increasing the bore size of the ion transfer tube that transports ions from the ionization chamber to the first low vacuum chamber is often complicated by two key issues:

1.) Firstly, more gas will flow from the atmosphere into the mass spectrometer, which will increase the pressures in each of the downstream pumping stages. At some point, the pressures can exceed those essential for the proper functioning of the radio frequency (RF) ion guides in each chamber causing a poor radial confinement and axial propulsion of ions towards the detector.

2.) Secondly, increasing the inner diameter of the capillary bore will reduce the amount of heat transfer from the body of the capillary to the flow stream. This contributes to poor de-solvation, depressed analyte response, and elevated chemical noise.

One common practice to overcome the two limitations involve increasing the number of pumping stages to gradually remove the excess gas load and increasing the capillary temperature to facilitate more heat transfer. However, signal losses caused by the additional pumping stage (or stages) and increases in chemical noise due to poor de-solvation have made such practice difficult and costly.

FIG. 4 is a schematic illustration of a portion, in particular, an outlet portion of a known ion transfer tube 15. The upper and lower parts of FIG. 4 respectively show a cross-sectional view and a perspective view of the outlet portion of the ion transfer tube 15. The ion transfer tube comprises a tube member 152 (in this example, a cylindrical tube) having a hollow cylindrical interior or bore 154, the flow direction through which is indicated by the dashed arrow. At the outlet end 151 of the ion transfer tube, the tube member 152 is terminated by a substantially flat end surface 156 that is substantially perpendicular to the length of the tube and to the flow direction. Further, a beveled surface or chamfer 158, which in the case of the cylindrical tube shown is a frustoconical surface, may be disposed at an angle to the end surface so as to intersect both the end surface 156 and the outer cylindrical surface of the tube member 152. The surface 158 may be used to align and seat the outlet end of the ion transfer tube against a mating structural element (not shown) in the interior of the intermediate vacuum chamber 13 or may be used so as to penetrate, upon insertion into a mass spectrometer instrument, a vacuum sealing element or valve, such as the sealing ball disclosed in U.S. Pat. No. 6,667,474, in the names of Abramson et al.

The number of ions delivered to the mass analyzer (as measured by peak intensities or total ion count) is partially governed by the flow rate through the ion transfer tube. One of the ways to increase the sensitivity of a mass spectrometer is to let in more ion laden-gas from the ionization chamber 7, provided that enough vacuum pumping is being applied to maintain a sufficient level of vacuum in the mass spectrometer for it to function. Unfortunately, the practice of offsetting the increased gas load of a wider bore ion transfer tube by increasing pumping capacity or the number of pumping stages (i.e., intermediate-vacuum chambers) so as to maintain a functional vacuum inside the mass spectrometer is generally seen as complicated and costly. Further, the approach of increasing the throughput of the conventional round-bore ion transfer tube 15, either by shortening it or increasing its inner diameter, has been found experimentally to be limited by how well the solvent surrounding the ions can be evaporated during the transfer time of the tube. The ion transfer tube may be heated to improve solvent evaporation and ion de-solvation. However, the maximum temperature that can be applied to the ion transfer tube is limited due to melting of nearby plastic parts as well as to fragmentation of fragile molecular ions such as certain peptides that may flow through the tube.

Traditionally ion funnels or stacked ring ion guides are constructed from a stack of parallel plates (metal or metalized around the orifice of an FR-4 printed circuit board), each plate having an orifice. In the case of ion funnels, the orifices are of decreasing diameter in the direction from the apparatus entrance to the apparatus exit. The outside edges of the plates are generally of quasi constant dimensions, shaped, for example, circularly, square, or some combination thereof. In some designs, also solid spacers are inserted between the plates to keep them apart.

As a result of this multiple parallel plate construction, high velocity gas from the expansion out of the ion transfer tube cannot easily escape the ion transport apparatus so that it can be pumped away. Consequently, gas pressure may increase to an undesirable level in the chamber containing the ion transport device. The internal pressure increase may be especially serious in the case of ion-funnel-type ion transport apparatuses, since the projection of the funnel along its symmetry axis shows or presents only the orifice at the end as an opening for escaping gas. The conductance between successive funnel electrodes is oriented close to perpendicular to the direction of the expansion, which creates a relatively high pressure area in the funnel. This has negatively affected the ion transmission efficiency of the ion funnel or stacked ring ion guide and, although operation at higher RF frequencies can help to alleviate this problem, reducing the pressure within the device itself is a better solution if one wants to keep increasing the throughput from the atmospheric pressure ionization source. In addition, the robustness of the device (as measured by the useful operational time between necessary cleanings) is limited by the beam impacting on the electrodes opposite the transfer tube.

SUMMARY OF THE INVENTION

In accordance with the present teachings, various ion transport systems are disclosed that include an ion transfer tube having one or more internal bores with an obround or slotted cross section. The ion transfer tube is configured so as to deliver ions to, in some embodiments, a conventional ion funnel or a stacked ring ion guide. Alternatively, the ion transfer tube may be configured to deliver ions to an open geometry funnel which allows separation of ions that are retained by the RF field from the gas stream that flows through gaps between the ring electrodes so as to be pumped away, by the vacuum pump connected to the vacuum chamber that houses the device. This configuration allows for a better control of the pressure within the device and improved overall ion transmission efficiency while limiting pumping requirements. The ion transfer tube is oriented such that the long dimension (i.e., the width) of its bore is within or oriented substantially parallel to or approximately parallel to a plane defined by and containing the axis of the ion transfer tube and an ion channel axis. The ion channel axis may be the central axis of either the ion funnel, or may be an ion channel axis of a stacked ring ion guide or an alternative open-geometry funnel device comprising the plurality of electrodes. The long dimension of the ion transfer tube bore or slot is considered to be "approximately parallel" to a plane, as that term is used in this document, when the long dimension makes an angle, with respect to the plane, of thirty degrees (30°) or less. The long dimension of the ion transfer tube bore or slot is considered to be "substantially parallel" to a plane, as that term is used in this document, when the long dimension makes an angle, with respect to the plane, of one degree (1°) or less. The ions and gas emitted from the ion transfer tube are delivered to the ion transport device. The gas emitted from the non-round bore expands as an asymmetric plume. By either offsetting the axis of the ion transfer tube from the axis of the ion channel of the ion transport device or positioning the tube such that its axis is at an angle to the axis of the ion channel of the ion transport device, the plume can be caused to impinge on the electrode plates in such a fashion that most of the gas is diverted away from a downstream evacuated chamber, such as a mass analyzer chamber. Gaps between electrode plates or additional apertures within the electrode plates may be configured with a position and shape so as to match the position and shape of the gas plume, thus exhausting the gas from the ion transport apparatus or system into an enclosing chamber from which it may be efficiently pumped away.

The neutral gas molecules may be exhausted from the ion transport apparatus or system though a plurality of gas channels or apertures that surround the ion channel. For example, the neutral gas molecules may be exhausted from the ion transport apparatus or system though a plurality of gas channels comprising gaps between a plurality a plurality of nested co-axial hollow tubes. Alternatively, the neutral gas molecules may be exhausted from the ion transport apparatus or system though a plurality of apertures in a plurality of electrode plates having the plurality of ring-shaped electrode portions. Alternatively, the neutral gas molecules may be exhausted from the ion transport apparatus though a plurality of gas channels comprising gaps between a plurality of nested electrode portions having shapes defined by bounding frustoconical surfaces.

Thus, in accordance with an aspect of the present teachings, there is provided a system for transporting ions from an ion source to an evacuated chamber of a mass spectrometer, the system comprising: (a) an ion transfer tube having an axis, an inlet end configured to receive the ions and gas from the ion source, an outlet end and an internal bore between the inlet and outlet ends having a first dimension comprising a width and a second dimension comprising a height, the width being greater than the height; (b) a plurality of electrodes, a plurality of surfaces of said electrodes comprising a plurality of non-co-planar rings defining a set of respective ion apertures that define an ion channel and whose centers define an ion channel axis and whose diameters decrease from a first end to a second end along the ion channel axis, the ion channel configured to receive the ions from the outlet end of the ion transfer tube and through which the ions are transported; and (c) a Radio Frequency (RF) power supply for providing RF voltages to the plurality of electrodes such that the RF phase applied to each electrode is different from the RF phase applied to any immediately adjacent electrodes, wherein the ion transfer tube is configured such that the ion transfer tube axis is non-coincident with the ion channel axis and such that the first dimension of the ion transfer tube bore is parallel or approximately parallel to a plane defined by the ion transfer tube axis and the ion channel axis.

In various embodiments, the plurality of electrodes may comprise a first set of electrodes and a second set of electrodes interleaved with the first set of electrodes, the electrodes of each set being electrically interconnected, wherein, in operation, the RF power supply supplies a first RF phase to the first set of electrodes and a second RF phase to the second set of electrodes. In various embodiments, the electrodes may be disposed such that gaps are defined between each pair of successive electrodes, the gaps being oriented such that the gas received from the outlet end of the ion transfer tube is exhausted through the gaps in one or more directions that are non-perpendicular to the ion channel axis. In various embodiments, the plurality of electrodes may comprise a plurality of co-axial hollow tubes comprising a plurality of respective tube lengths, the tube lengths of the tubes decreasing in sequence from an outermost one of the tubes to an innermost one of the tubes.

In some other embodiments, each of the plurality of electrodes is a ring electrode. Each of the plurality of ring electrodes may be supported on a respective one of a plurality of co-axial hollow tubes, each tube being formed of a non-electrically conducting material. The plurality of hollow tubes may comprise a plurality of respective tube lengths, the tube lengths of the tubes decreasing in sequence from an outermost one of the tubes to an innermost one of the tubes. Alternatively, each of the plurality of ring electrodes may be supported on a respective one of a plurality of supporting structures having frustoconical inner and outer surfaces, wherein each supporting structure comprises a respective axis of rotational symmetry that is coincident with the axis of the ion channel of the apparatus having the plurality of electrodes. In some embodiments, each of the plurality of ring electrodes may be supported by one or more spokes disposed non-parallel to the ion channel axis, each of the spokes having an end that is physically coupled to an external housing or supporting device. In various embodiments, some of the plurality of electrodes may comprise at least one additional aperture, said additional apertures disposed such that the gas received from the outlet end of the ion transfer tube is exhausted through the additional apertures. The at least one additional aperture of at least one plate may be disposed so as to, in operation, align with, overlap with or match the position and shape of a gas plume emitted from the outlet end of the ion transfer tube.

In some embodiments, the ion transfer tube may be configured such that the ion transfer tube axis is parallel to and offset from the axis of an ion channel of an associated ion transport apparatus. In other embodiments, the ion transfer tube may be configured such that the ion transfer tube axis is disposed substantially at ninety degrees relative to the ion channel axis. In some embodiments, the ion transfer tube comprises two or more parallel internal bores or slots. In some embodiments, a dimension or cross sectional area of an internal bore or slot of the ion transfer tube may decrease along the length of the ion transfer tube in a direction from a tube inlet to a tube outlet.

According to another aspect of the invention, a method for transporting ions from an ion source to an evacuated chamber of a mass spectrometer is provided, the method comprising: (i) providing an ion transfer tube having an axis, an inlet end configured to receive the ions and to receive gas from the ion source, an outlet end and an internal bore between the inlet and outlet ends having a first dimension comprising a width and a second dimension comprising a height, the width being greater than the height; (ii) providing an ion transport apparatus comprising a plurality of electrodes, a plurality of surfaces of which comprise a plurality of non-co-planar rings defining a set of respective ion apertures whose diameters decrease along an axis of the ion transport apparatus from an ion input end to an ion exit aperture at an ion exit end, the set of ion apertures defining an ion channel through which the ions are transported to the evacuated chamber from the ion exit aperture; and (iii) providing RF voltages to the plurality of electrodes such that the RF phase applied to each electrode is different from the RF phase applied to any immediately adjacent electrodes, wherein the electrodes are disposed such that gaps are defined between each pair of successive electrodes, the gaps being oriented such that a gas flow input into the first end of the apparatus is exhausted through the gaps in one or more directions that are non-perpendicular to the axis, wherein the ion transfer tube is oriented, with respect to the apparatus, such that a primary zone of impingement of the gas upon the plurality of electrodes does not coincide or overlap with the ion exit aperture.

BRIEF DESCRIPTION OF THE DRAWINGS

The above noted and various other aspects of the present invention will become apparent from the following description which is given by way of example only and with reference to the accompanying drawings, not drawn to scale, in which.

DETAILED DESCRIPTION

The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the appended figures taken in conjunction with the following description.

Figure 5A:
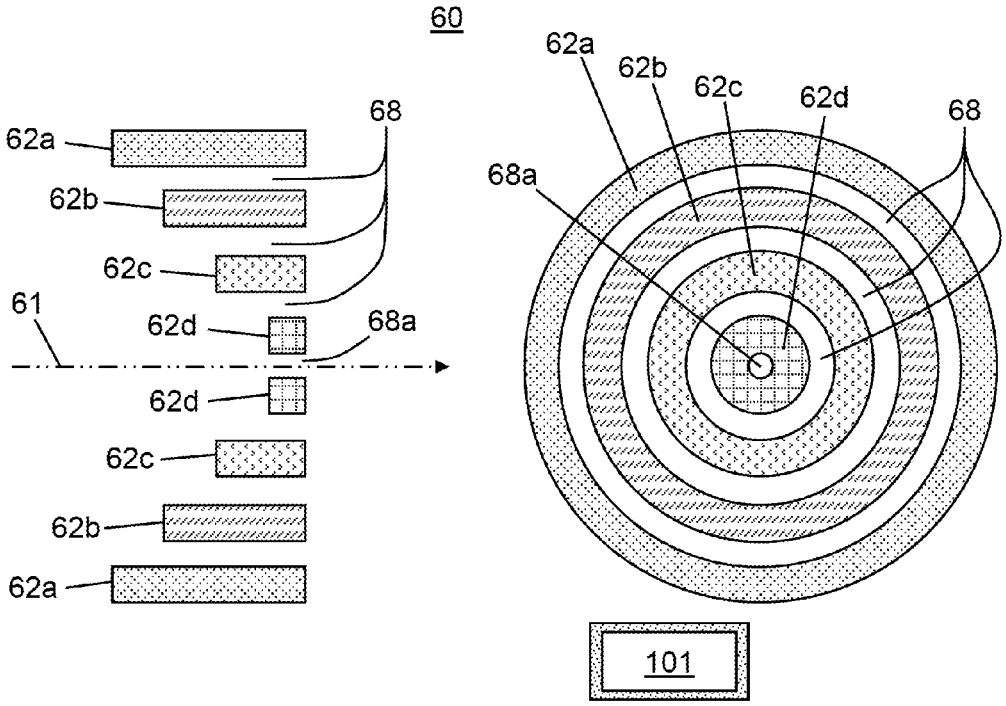
FIGS. 5A-5B are pairs of schematic diagrams of a first ion transport apparatus in accordance with the present teachings.
Figure 5B:
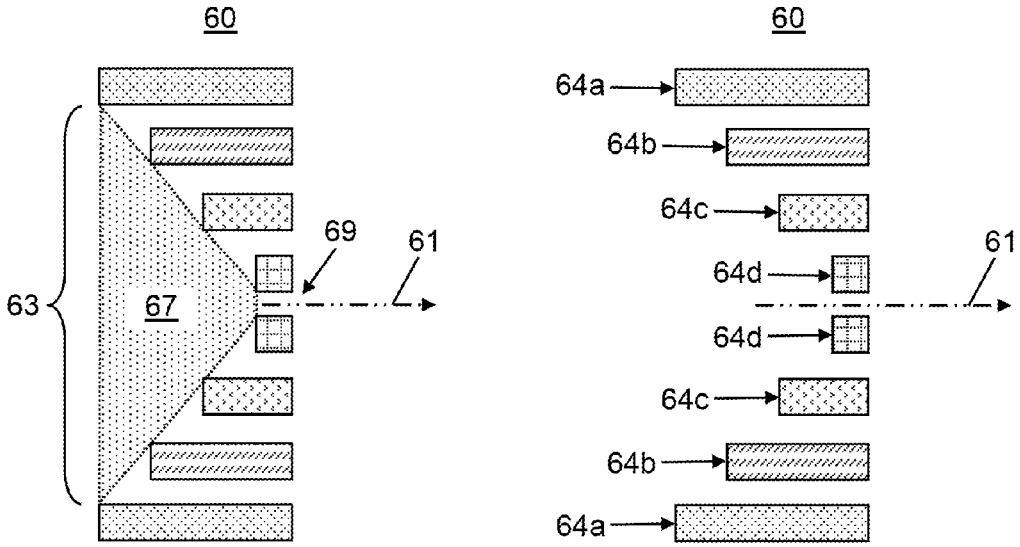

FIGS. 5A-5B provide schematic illustrations of a first ion transport apparatus that may be employed in systems in accordance with the present teachings. The ion transport apparatus illustrated in FIGS. 5A-5B in the Applicant's U.S. Pat. No. 8,907,272, which is incorporated herein by reference in its entirety. The ion transport apparatus 60 illustrated in FIG. 5A comprises a plurality of nested coaxially disposed tubular circularly-cylindrical electrodes. In the example shown in FIGS. 5A-5B, four such tubular electrodes are shown comprising an outer tubular electrode 62*a*, a second tubular cylindrical electrode 62*b* disposed coaxially with and interiorly with regard to the outer tubular electrode 62*a*, a third tubular cylindrical electrode 62*c* disposed coaxially with and interiorly with regard to the second tubular electrode 62*b*, and an inner tubular electrode 62*d* disposed coaxially with and interiorly with regard to the third tubular electrode 62*c*. The leftmost diagram of each of FIGS. 5A-5B is a longitudinal cross sectional view through the apparatus. The rightmost diagram of each of FIGS. 5A-5B is a projected view of the apparatus along the axis 61 and in the direction of the arrow noted on that axis. Although four electrodes are shown in FIGS. 5A-5B and in other instances of the accompanying drawings, the number of electrodes is not intended, in any instance, to be restricted or limited to any particular number of electrodes.

Figure 1A:
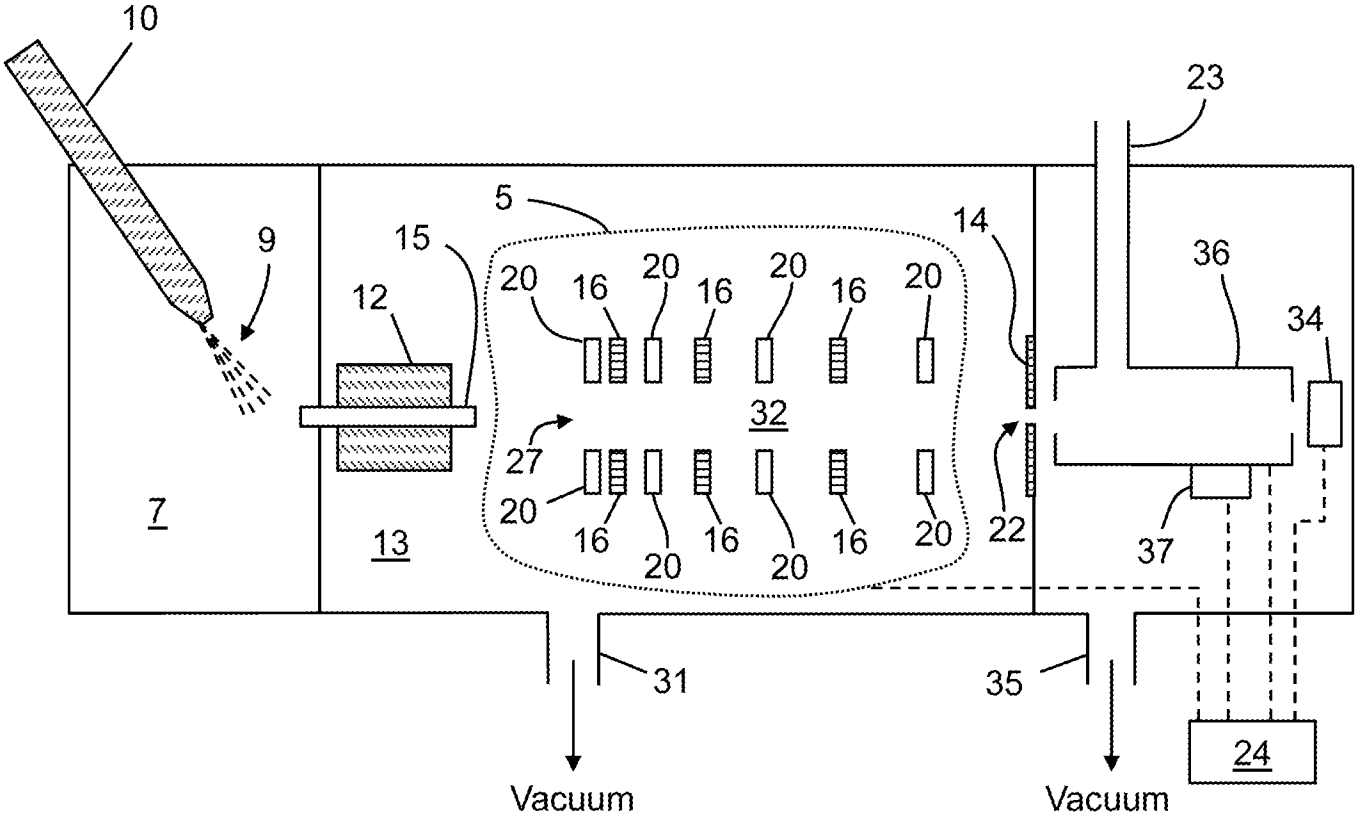
FIG. 1A (Prior Art)
FIG. 1A is a schematic depiction of a first mass spectrometer system in conjunction with which various embodiments in accordance with the present teachings may be practiced.
Figure 1B:
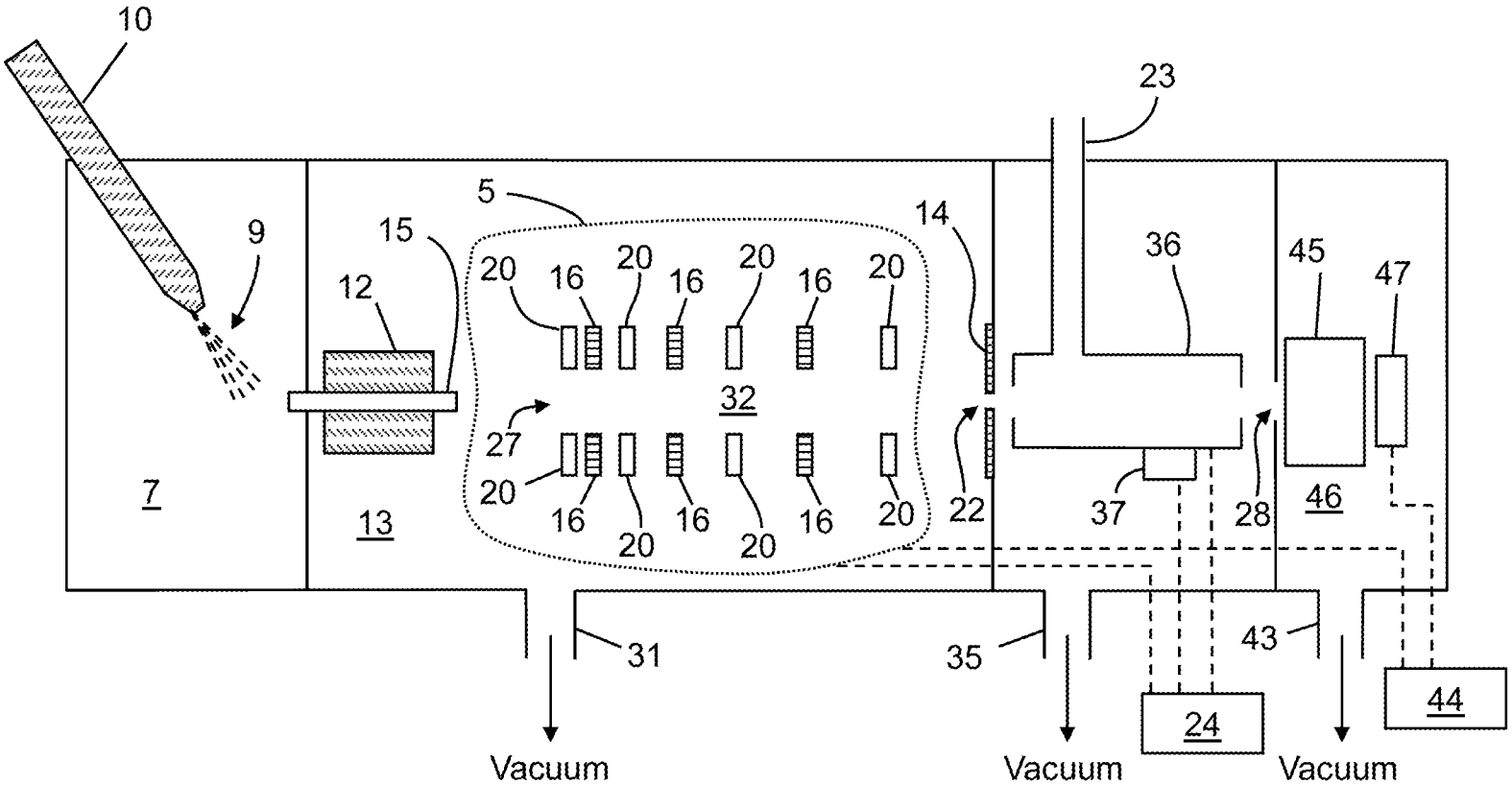
FIG. 1B (Prior Art)
FIG. 1B is a schematic depiction of a second mass spectrometer system in conjunction with which various embodiments in accordance with the present teachings may be practiced.
Figure 2A:
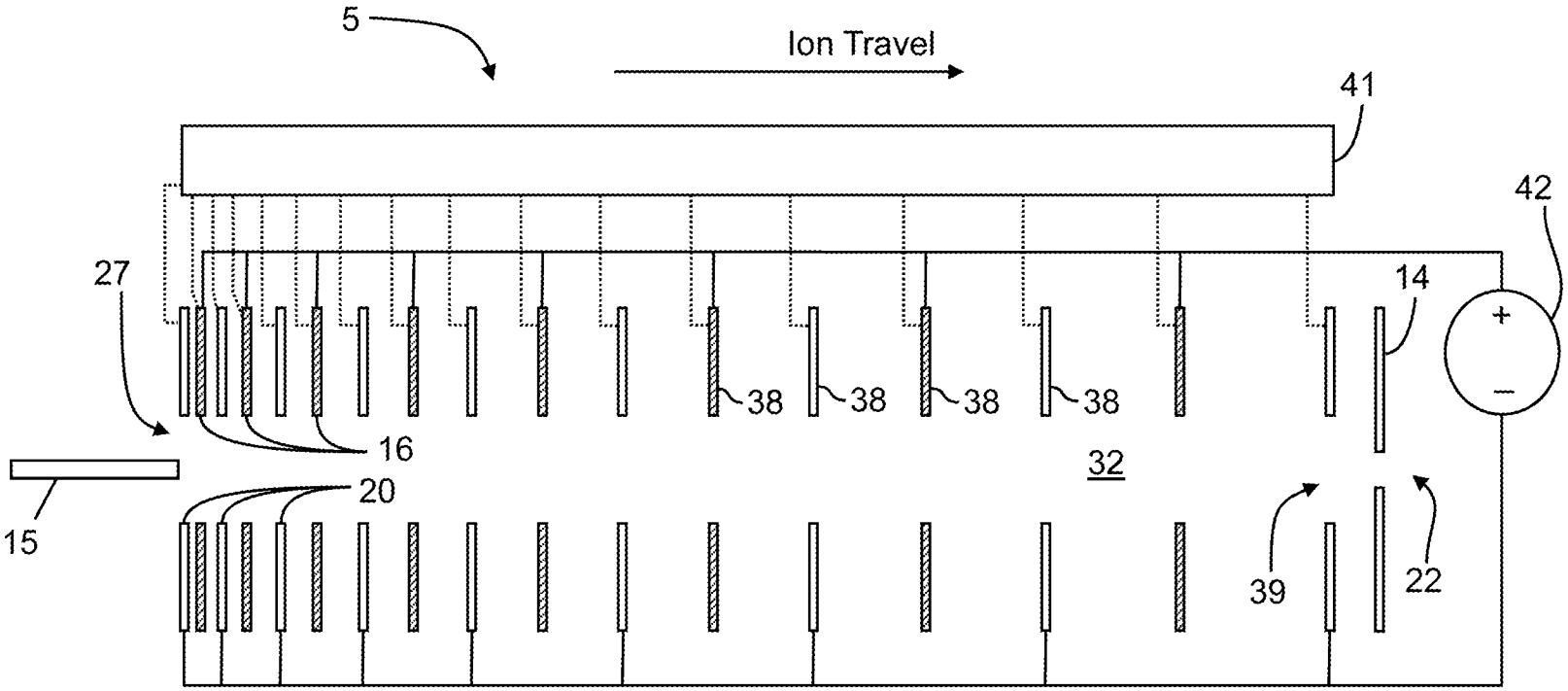
FIG. 2A (Prior Art)
FIG. 2A is a cross-sectional depiction of a stacked-ring ion guide (SRIG) ion transport device used in the mass spectrometer systems of FIG. 1.
Figure 2B:
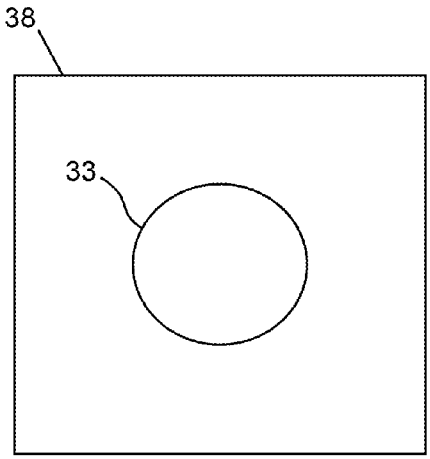
FIG. 2B (Prior Art)
FIG. 2B is a diagram of a single ring electrode of the SRIG ion transport device of FIG. 2A.

Axis 61 is the common axis of the plurality of tubular electrodes 62*a*-62*d* and is also the axis of a convergent ion channel 67. The apparatus 60 has an entrance 63 at which gas and charged particles (primarily ions) enter the apparatus and an ion exit 69 along axis 61 at which charged particles (primarily ions) exit the apparatus in the direction of the arrow indicated on axis 61. The entrance 63 is defined by the bore of the outer electrode 62*a* at an end of that electrode that faces an ion source (not shown) whose position is to the left of the leftmost diagrams of FIGS. 5A-5B. Power supply 101 applies RF voltages to the electrodes and, optionally, DC voltage offsets between adjacent electrodes so as to cause the trajectories of the charged particles to converge towards the central axis 61 within an internal ion channel 67 that functions as an ion transport and convergence region. The ion channel 67 as well as its convergence region is defined by the set of ends 64*a*-64*d* of the tubular electrodes that face the ion source. Each such end, other than the end of the outer tubular electrode 62*a*, is recessed within the interior of the adjacent enclosing electrode as illustrated in FIGS. 5A-5B. Thus, with regard to the set of ends of the tubular electrodes that face the ion source, each such end of each progressively inward electrode is recessed with regard to the comparable end—that is, the end facing the ion source—of the immediately enclosing electrode. This configuration gives rise to a funnel shaped ion channel 67 with the diameter of the funnel narrowing in the direction from the entrance 63 to the exit 69. The exit 69 of the apparatus 60 is adjacent to and aligned with the aperture 22 of extraction lens 14 (see FIGS. 1A-1B) such that the charged particles (primarily ions) pass through the aperture into a lower-pressure chamber.

The co-axial tubular electrodes 62*a*-62*d* are nested in a fashion such that a series of annular gaps 68 exist between pairs of adjacent electrodes. Although ions and possibly other charged particles are caused to converge towards the central axis by the application of voltages applied to the electrodes, the gas jet that comprises neutral gas molecules emerging from the ion source (not shown) undergoes rapid expansion during its entry into and passage through the apparatus 60. The jet expansion causes the majority of neutral gas molecules to diverge away from the central axis 61 so as to be intercepted by and exit the apparatus through one of the annular gaps 68. The annular gaps 68 are not aligned with the aperture 22 of extraction lens 14 (see FIGS. 1A-1B) and thus gas that exits through the gaps 68 is primarily exhausted through vacuum port 31 and is thus separated from the ions.

The configuration of the electrodes of the apparatus 60 is such that most of the gas can escape through the annular gaps 68 without impinging upon an electrode surface at a high angle. Electrically insulating spacers (not shown) may be placed within the annular gaps so as to maintain the relative dispositions of the tubular electrodes. The size and positioning of such spacers may be chosen so as to minimize blocking of the gas flow through the annular gaps. Although a small amount of gas may exit together with ions through the lumen 68*a* of the innermost tubular electrode 62*d*, the quantity of gas that exits in this fashion may be minimized by maintaining a small diameter of the lumen 68*a*. The electrode configuration of the ion transport apparatus 60 thus inhibits buildup of gas pressure within the apparatus.

Figure 5C:
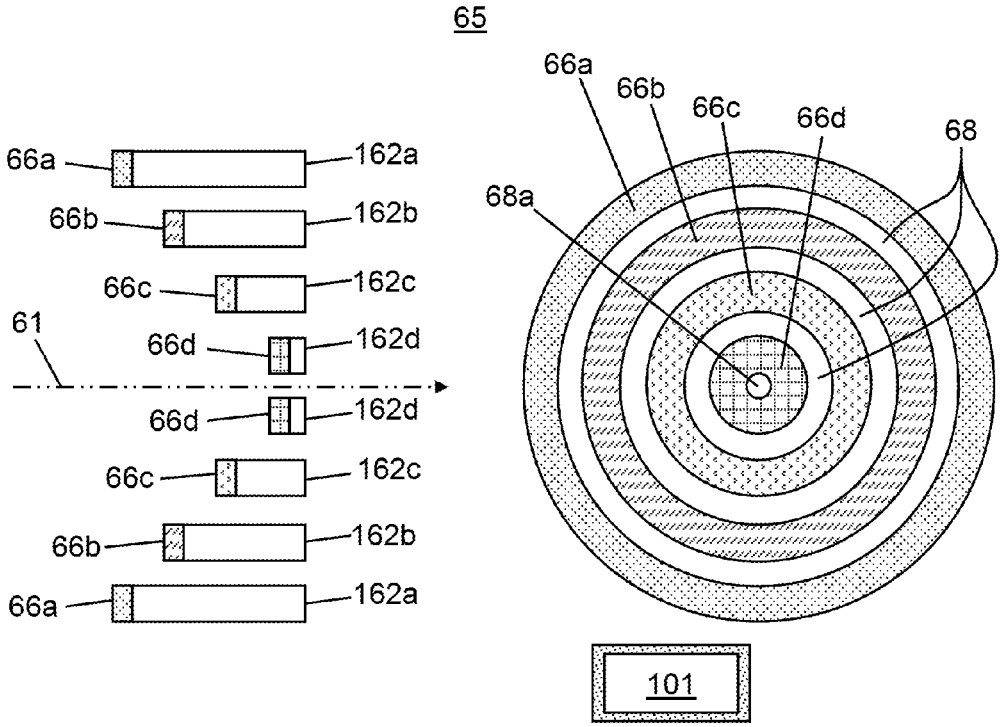
FIG. 5C is a pair of schematic diagrams illustrating a variation of the ion transport apparatus depicted in FIGS. 5A-5B.

As illustrated in FIGS. 5A-5B, each one of the electrodes 62*a*-62*d* is a tube. However, it is not necessary for each tube to be wholly composed of electrically conductive electrode material. For example, in some embodiments, the electrode portions may comprise electrically conductive coatings on tubes formed of electrically insulating material. For example, in the modified ion transport apparatus 65 illustrated in FIG. 5C, electrically insulating tubes 162*a*-162*d* are disposed similarly to the disposition of tubular electrodes 62*a*-62*d* shown in FIGS. 5A-5B. Accordingly, annular gaps 68 are defined between tubes 162*a*-162*d* (FIG. 5C) in the same fashion that such gaps are formed between tubular electrodes 62*a*-62*d* (FIGS. 5A-5B), thereby allowing escape of gas through the annular gaps in the same fashion as discussed above. Note that the leftmost diagram of FIG. 5C is a longitudinal cross sectional view through the apparatus and the rightmost diagram is a projected view of the apparatus along the axis 61 in the direction of the arrow. However, the plurality of electrodes of the of the ion transport apparatus 65 comprise a plurality of electrode members 66*a*-66*d*, such as plates, rings or coatings, that are attached to or affixed to the tubes 162*a*-162*d*. Thus, the electrode members 66*a*-66*d* are supported at the ends of the tubes that face the ion source (not shown) whose position is to the left of the leftmost diagram of FIG. 5C. The tubes may support electrical leads (not shown) that are electrically coupled to the electrode members so that the appropriate RF and DC voltages may be applied to the electrode members. As in the apparatus 60 (FIGS. 5A-5B), these applied voltages cause charged particles (primarily ions) to migrate to the central axis 61 and to exit through the lumen 68*a* of the innermost tube 162*d*. The design shown in FIG. 5C produces reduced-capacitance apparatus relative to conventional ion funnel devices thereby reducing the performance requirements and cost of an RF power supply to which the apparatus is electrically coupled.

Figure 6:
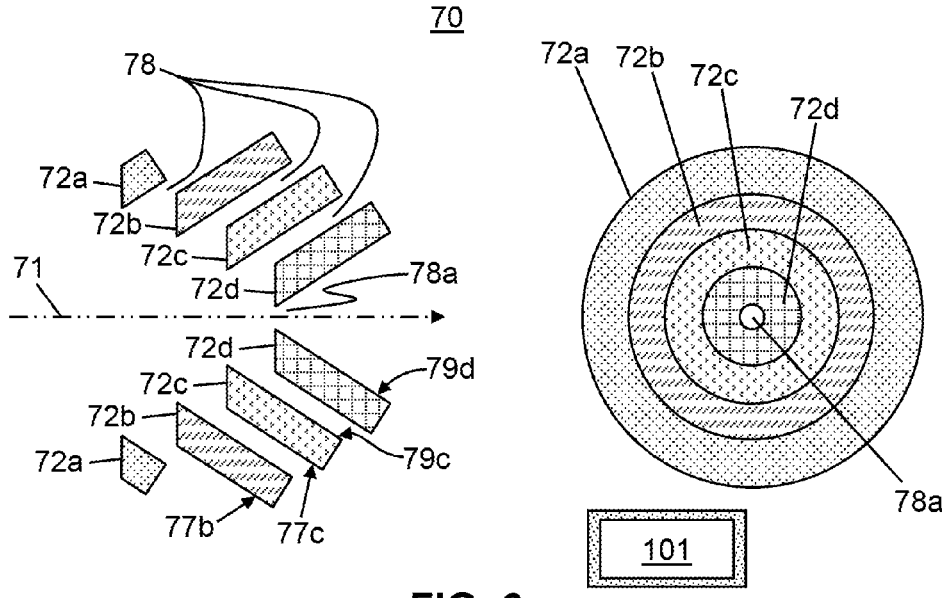
FIG. 6 is a pair of schematic diagrams of a second ion transport apparatus in accordance with the present teachings.

FIG. 6 provides schematic illustrations of another ion transport apparatus—ion transport apparatus 70—as taught in U.S. Pat. No. 8,907,272 and as may be employed in systems in accordance with the present teachings. Similarly to each of FIGS. 5A-5C, the leftmost diagram of FIG. 6 is a longitudinal cross sectional view through the apparatus 70 and the rightmost diagram is a projected view of the apparatus 70 along the central axis 71 of the apparatus and its associated ion channel as viewed in the direction of the arrow. In contrast to the previously-described ion transport apparatus 60 (FIGS. 5A-5B), the electrodes 72*a*-72*d* of the ion transport apparatus 70 are not in the form of cylindrical tubes but, instead, take the form of nested truncated right-circular cones, the truncated narrow portions of the cones facing the ion source (not shown) which is at the left side of the leftmost diagram of FIG. 6. More specifically, each of the electrodes 72*a*-72*d* is bounded by a respective outer surface (e.g., outer surfaces 77*b* and 77*c* as well as corresponding surfaces on other instances of the electrodes) and a respective inner surface (e.g., inner surfaces 79*c* and 79*d* as well as corresponding surfaces on other instances of the electrodes), with each of the outer and inner surfaces comprising a frusto-conical surface. The central axis 71 is the axis of radial symmetry of each of the truncated conical electrodes. Power supply 101 applies RF voltages to the electrodes and, optionally, DC voltage offsets between adjacent electrodes so as to cause the trajectories of the charged particles to converge towards the central axis 71 and the orifice 78*a*.

Still referring to FIG. 6, the innermost electrode 72*d* of the apparatus 70 has the orifice 78*a* at its truncated end which is centered on the axis 71 and which serves as an ion exit for the apparatus. The innermost truncated conical electrode is nested within truncated conical electrode 72*c* which is in the form of a similar truncated right-circular cone that is truncated so as to have an opening at its truncated end that is wider than the orifice 78*a* of truncated conical electrode 72*d*. Likewise, the truncated conical electrode 72*c* is nested within truncated conical electrode 72*b* which is itself nested within truncated conical electrode 72*a*. This configuration of truncated conical electrodes defines a funnel shaped ion convergence region within the interior of the apparatus that is similar to the convergent ion channel 67 shown in FIG. 5B. Further, since the cones have similar angular conical apertures, a series of gaps 78 is defined between the cones. Accordingly, expanding gas emerging from an ion source (not shown) can easily be intercepted by the gaps and exhausted from the apparatus.

As in the apparatus 60 (FIGS. 5A-5B), RF and DC voltages applied to the electrodes cause charged particles (primarily ions) to migrate to the central axis 71 and to exit through the orifice 78*a* of the innermost electrode 72*d* thereby providing efficient separation of the charged particles from the gas. Similarly to the construction of the apparatus 65 (FIG. 5C), the electrodes may alternatively be provided as conductive coatings on the truncated ends of the truncated cones, where the truncated cones are formed, in this alternative case, of electrically insulating material. In such a case, each electrode is supported on a respective one of the truncated cone structures, the supporting structure being bound by frustoconical inner and outer surfaces. The truncated cone structures may be formed by the technique of additive manufacturing (commonly known as "3D printing") in which successive layers of material are laid down in different shapes with regard to different layers.

Figure 7:
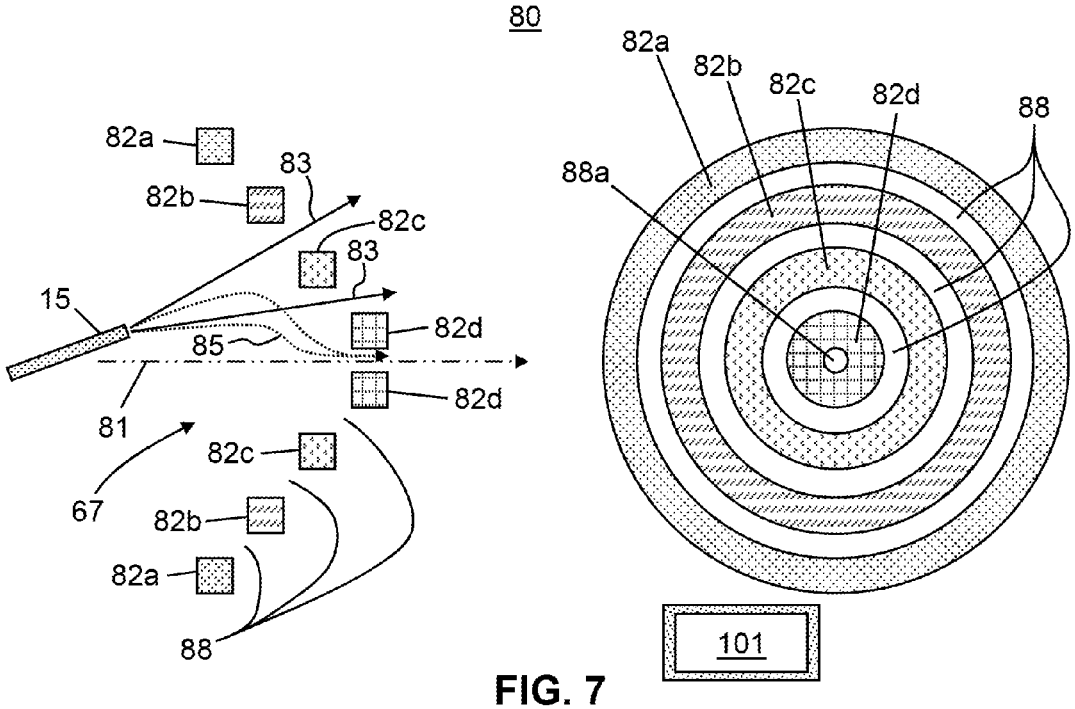
FIG. 7 is a pair of schematic diagrams of a generalized ion transport apparatus in accordance with the present teachings.

FIG. 7 provides a schematic illustration of a generalized apparatus having an open gas-exhaust structure that is consistent with many various different physical support structure configurations illustrated herein (e.g., FIGS. 5A-5C, 6, 7 and 8A) but that is not specifically restricted to any particular such configuration. As in the previously described drawings, the leftmost diagram of FIG. 7 is a longitudinal cross sectional view through the generalized apparatus 80 and the rightmost diagram is a projected view of the apparatus 80 along the central axis 81 of the apparatus and its associated convergent ion channel as viewed in the direction of the arrow on that axis. FIG. 7 also illustrates an ion transfer tube 15 (or, possibly, an ion source) as well as a generalized schematic pathway 85 of ions through the apparatus and a generalized schematic pathway 83 of gas through the apparatus.

The apparatus 80 of FIG. 7 is shown as comprising four electrodes—electrodes 82*a*, 82*b*, 82*c* and 82*d*—although, in a more general sense, the apparatus 80 comprises a plurality of electrodes which is not intended to be restricted or limited to any specific number of electrodes. In FIG. 7, the electrodes are shown as having a circular face or as having a circular projection in transverse cross section (e.g., such as ring electrodes or cylindrical electrodes) but the structure is not intended to be limited to such embodiments. For example, the electrodes could present a polygonal face in transverse cross section or could comprise a plurality of segments. Power supply 101 applies RF voltages to the electrodes and, optionally, DC voltage offsets between adjacent electrodes so as to cause the trajectories of the charged particles to converge towards the central axis 81 as is schematically illustrated by ion trajectories 85. The plurality of electrodes may be divided into a plurality of first electrodes (for example, electrodes 82*a* and 82*c* of FIG. 7) that are interleaved with a plurality of second electrodes (for example, electrodes 82*b* and 82*d* of FIG. 7), with the first electrodes receiving an oscillatory voltage that is opposite in phase with respect to the oscillatory voltage applied to the second electrodes.

A set of faces of the electrodes 82*a*-82*d* of the apparatus 80 are configured so as to define a funnel-shaped ion channel 67 which functions as ion transport and convergence region (see also FIG. 5B) such that the diameter of the funnel becomes narrower in the general direction from the ion entrance to the ion exit of the apparatus, i.e., in the direction of the arrow indicated on axis 81. The ion exit coincides with a lumen or aperture 88*a* in the electrode that is closest to the axis (electrode 82*d* in the illustrated example). It is understood that the lumen or aperture 88*a* is disposed in alignment with and adjacent to an aperture (e.g., the aperture 22 shown in FIG. 1) that leads the ions into a lower-pressure chamber after the ions pass through the lumen or aperture 88*a*. The electrodes are further configured such that a plurality of open gaps 88 is defined between pairs of adjacent electrodes. By contrast, the gaps 88 are not adjacent to or aligned with the aperture that leads into the lower pressure chamber.

During operation of the ion transport apparatus 80, gas comprising neutral molecules emerges from the exit end of the ion transfer tube 15 or other entrance orifice. In many situations, the ion-laden gas may emerge from the ion transfer tube or orifice as an expanding jet that generally expands outward in many directions across a range of angles. The expansion may be axisymmetric about an extension of the axis of the ion transfer tube, if the tube comprises a simple bore that is circular in cross section. However, if the tube bore comprises a different shape—such as a "letterbox" or arcuate shape—or comprises multiple such bores, then the gas expansion will be generally non-isotropic as discussed in greater detail below. Two representative gas trajectories are indicated as gas flow paths 83 in FIG. 7. As a result of this expansion and the configuration of the electrodes, most of this gas encounters one or more of the gaps 88 and is exhausted from the apparatus through these gaps. Preferably, the ion transfer tube 15 is slightly angularly mis-aligned with the apparatus axis 81 such that there does not exist a direct line of sight from the exit end of the ion transport tube 15 to the lumen or aperture 88*a* (note that the angular mis-alignment is exaggerated in FIG. 7). As a result of this slight mis-alignment, there is no un-impeded gas molecule trajectory from the ion transfer tube 15 to the aperture (not-illustrated) leading to the lower pressure chamber. The gas that exhausts through gaps 88 also does not directly encounter this aperture. Consequently, a very high proportion of the gas is prohibited from being transported into the lower-pressure chamber and is thus removed from the chamber containing the ion transport apparatus (e.g., chamber 13 in FIG. 1) by an evacuation port (e.g., vacuum port 31) associated with that chamber.

As similarly noted above with regard to conventional ion funnel devices, if the ion-laden gas from an ion source emerges into an ion transport apparatus as a high-velocity and rapidly expanding jet, then it is desirable to provide a minimum lateral distance between the end of the ion transfer tube or orifice 15 and the electrodes (e.g., electrodes 82*a*-82*d* as shown in FIG. 7, electrodes 62*a*-62*d* shown in FIGS. 5A-5B, electrodes 72*a*-72*d* as shown in FIG. 6, etc.) so that the initial high velocity of the emerging gas may be sufficiently dampened by collisions with background gas such that the trajectories of the ions may be manipulated independently of the gas flow. In the case of ion transfer tubes having counterbored exit ends (see for example U.S. Pat. No. 8,242,440 to Splendore et al.) where the beam velocity is greater than it would otherwise be using conventional ion transfer tubes, the minimum distance required would be correspondingly larger.

In accordance with the above considerations, the proximity of the ion transfer tube 15 to the electrodes 82*a*-82*d* as shown in FIG. 7 should be regarded as schematic only. In practice, it may be necessary to extend the distance—beyond what is depicted in the accompanying drawings—between the ion transfer tube or aperture and the illustrated electrode structures in order to satisfy a requirement for a minimum lateral distance. At the practical operating pressures of these devices in the 0.5-10 Ton range, this minimum lateral distance has found experimentally by the inventors to be in the range 55-80 mm. The extra distance may be provided by additional electrode members or electrode plates between the ion transfer tube or orifice and the illustrated electrodes. The additional electrode members or electrode plates may be formed so as to provide a passageway for the ions in which the ions may lose kinetic energy through collisions with background gas. The additional electrode members or plates may be fashioned in the form of a conventional ion transport device such as, for example, a stack of mutually-similar, apertured electrode plates (e.g., ring electrodes) wherein RF voltages of different phases are applied to the electrode members or electrode plates. Such configurations are known, for example, in conventional stacked-ring ion guides or, possibly, as are configured in the ion transport device 5 shown in FIG. 1. Note that this optional conventional set of untapered electrodes is not depicted in many of the accompanying figures.

In contrast to the generalized or average gas molecule trajectories discussed above, the ion trajectories 85 are caused to generally converge towards the central axis by the action of RF and possibly DC voltages applied to the electrodes 82*a*-82*d*. The applied DC voltages may also aid in the transport of ions in the general direction of the arrow indicated on the central axis 81. Consequently, a large proportion of the ions are caused to pass through the lumen or aperture 88*a* of the innermost electrode 82*d*. Thus, these ions are efficiently separated from neutral gas molecules and are transported into the lower-pressure chamber.

Figure 3:
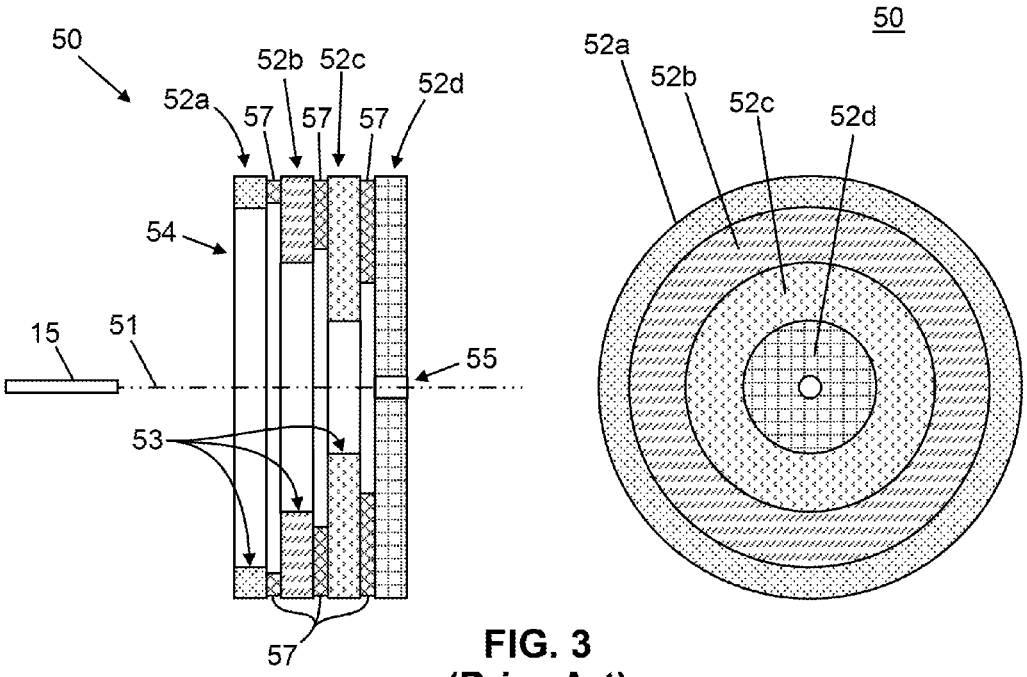
FIG. 3 (Prior Art)
FIG. 3 is a pair of schematic cross sectional diagrams of a prior-art ion funnel apparatus.
Figure 4:
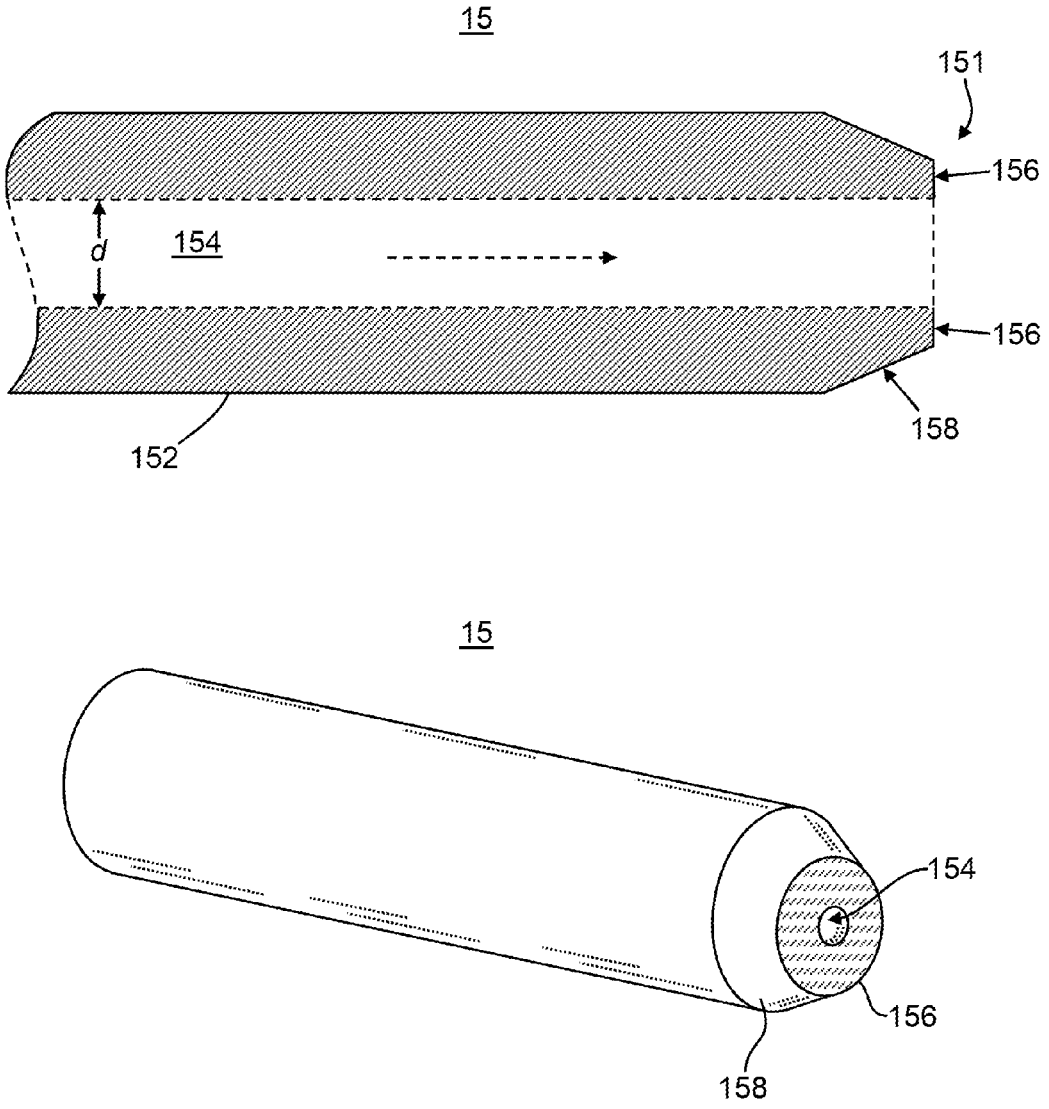
FIG. 4 (Prior Art)
FIG. 4 is a schematic illustration of a portion of a conventional round-bore ion transfer tube in both cross-sectional and perspective views.
Figure 8A:
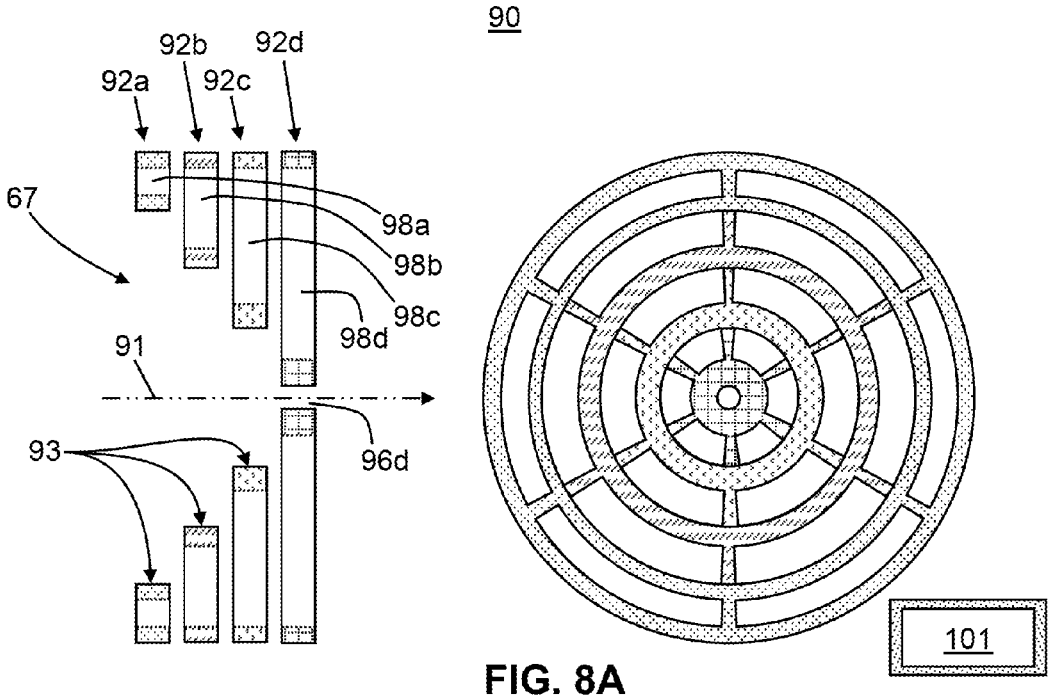
FIG. 8A is a pair of schematic diagrams of another ion transport apparatus in accordance with the present teachings.
Figure 8B:
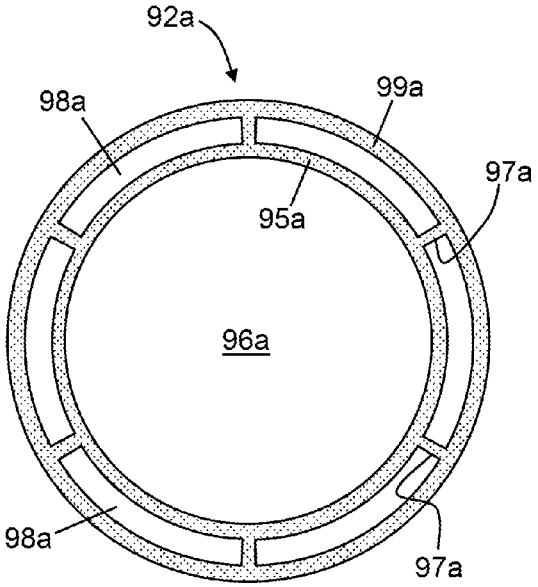
FIGS. 8B-8E are respective depictions of four separate electrode structures or electrode-bearing structures included in the ion transport apparatus of FIG. 8A.
Figure 8C:
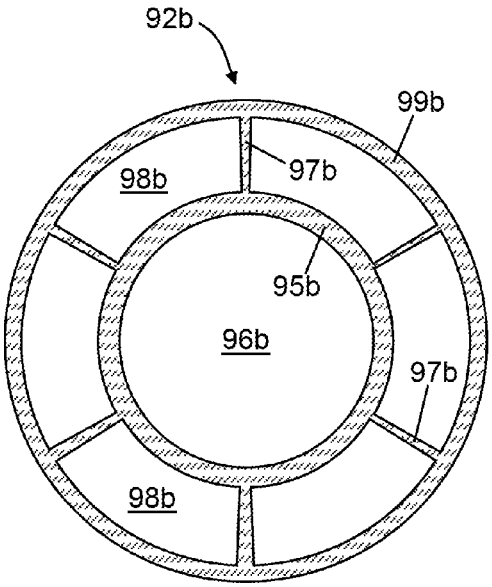
Figure 8D:
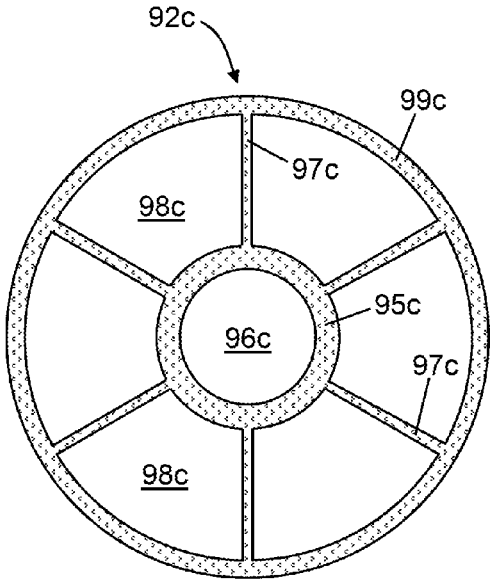
Figure 8E:
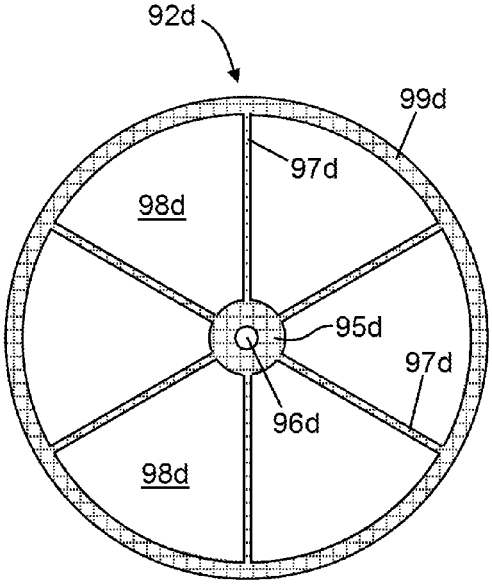

FIG. 8A illustrates another embodiment of an ion transport apparatus as taught in U.S. Pat. No. 8,907,272 and showing a specific example of the above-described general considerations. FIG. 8A provides a generalized depiction of the ion transport apparatus 90 with the leftmost diagram of FIG. 8A being a longitudinal cross sectional view through the apparatus 90 and the rightmost diagram of FIG. 8A being a projected view of the apparatus 90 along the central axis 91 of the apparatus and its associated convergent ion channel as viewed in the direction of the arrow on that axis. The apparatus comprises a plurality of ring electrodes, not limited or restricted to any particular number of electrodes, which are illustrated by the four exemplary ring electrodes 92*a*-92*d*. Power supply 101 applies RF voltages to the ring electrodes and, optionally, DC voltage offsets between adjacent ring electrodes so as to cause the trajectories of the charged particles to converge towards the central axis 91. In similarity to general nature of ring electrodes 52*a*-52*d* (e.g., see FIG. 3) of conventional ion funnel apparatuses, the ring electrodes of the apparatus 90 each have a short dimension (i.e., a thickness) that is oriented substantially parallel to the central axis 91. In other words, the long dimension (or dimensions) of the various ring 92*a*-92*d* are oriented substantially perpendicular to the central axis 91.

In similarity to the nature of ring electrodes in conventional ion funnel apparatuses, each ring electrode has a central opening that is preferably circular in shape, such that the diameters of at least a subset of the various ring electrodes progressively decrease in a general direction from the ion entry to the ion exit of the apparatus. FIGS. 8B, 8C, 8D and 8E illustrate the individual ring electrodes 92*a*, 92*b*, 92*c* and 92*d*, respectively. The respective central openings are illustrated as openings 96*a*, 96*b*, 96*c* and 96*d*. The inner faces 93 (see FIG. 8A) of these various central openings define a funnel-shaped ion channel 67 within the apparatus 90. The central opening of the first ring 67*a* (the largest-diameter opening) defines the ion entry of the apparatus 90 and the central opening 96*d* of the last ring 67*d* (the smallest-diameter opening) defines the ion exit of the apparatus.

Each of the ring electrodes 92*a*-92*d* of the novel apparatus 90 includes additional apertures that are separated from the respective central opening so as to define an inner ring between the central opening and the additional apertures. This configuration is illustrated in FIGS. 8B, 8C, 8D and 8E in which the additional apertures are indicated as apertures 98*a*, 98*b*, 98*c* and 98*d*, respectively and in which the central rings are indicated as central rings 95*a*, 95*b*, 95*c* and 95*d*, respectively. The presence of the apertures 98*a*-98*d* further defines outer rings which are indicated as outer rings 99*a*, 99*b*, 99*c* and 99*d* in FIGS. 8B, 8C, 8D and 8E, respectively. The central rings may be physically supported by and connected to the outer rings by spoke portions 97*a*, 97*b*, 97*c* and 97*d*. The sizes of the additional apertures 98*a*-98*d* of at least a subset of the various ring electrodes progressively increase in a general direction away from the ion entry of the apparatus. The progressive size increase of the apertures 98*a*-98*d* occurs through progressive extension of these apertures further towards the central axis 91 as ring electrodes progressively closer to the ion exit are considered and is accommodated by the simultaneous size decrease of the central openings in the same direction. This progressive size increase of the apertures 98*a*-98*d* enables these apertures to intercept a large portion of the diverging gas molecule trajectories within the apparatus.

Each ring electrode may be fabricated as a single integral piece formed of a conductive material (e.g., a metal) by drilling, cutting or punching out the central openings and additional apertures from, by way of non-limiting example, pre-existing coin-shaped circular metal blanks. Alternatively, each of the ring electrodes may be fabricated from an electrically insulating material with only certain portions having an electrically conducting coating (e.g., a metal coating) thereon. In various embodiments, the conductive coating may occupy only the central ring portions 95*a*-95*d* with additional conductive coatings on portions of the spokes 97*a*-97*d* and outer rings 99*a*-99*d* , these additional conductive coatings serving as electrical leads to the various coated central rings. Alternatively, one or more of the central ring portion, outer ring portion or spoke portions may be formed from a different material from the other portions.

In operation of the ion transport apparatus 90, RF and possibly DC voltages are applied to the center ring portions 95*a*-95*d* of the ring electrodes 92*a*-92*d* in known fashion so as to cause charged particles (primarily ions) provided from an ion source or ion transfer tube (not shown) to converge towards the central axis while also moving towards the ion exit 96*d* of the apparatus. The ions that pass through ion exit 96*d* are then focused into an aperture that leads into a lower pressure chamber, this aperture being adjacent to and aligned with the ion exit 96*d*. In contrast, gas comprising neutral gas molecules is intercepted by one or more of the apertures 98*a*-98*d*. This gas passes substantially unimpeded through the apertures 98*a*-98*d* so as to be exhausted from the apparatus into the chamber in which the ion transport apparatus is contained. This gas is then substantially removed by an evacuation port (e.g., vacuum port 31) associated with the chamber in which the ion transport apparatus 90 is contained. In this way ions are effectively separated from neutral gas molecules without buildup of gas pressure within the ion transport apparatus.

Figure 9A:
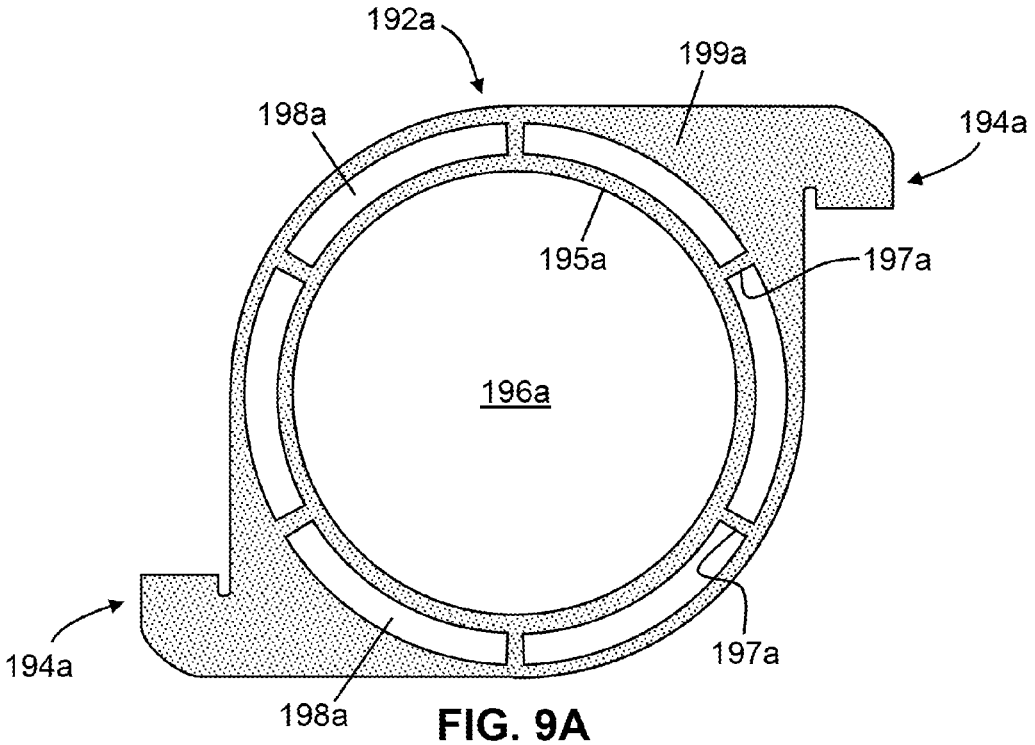
FIGS. 9A-9B are respective depictions of two separate electrode structures or electrode-bearing structures that may be included as part of an alternative set of such structures in the ion transport apparatus of FIG. 8A.
Figure 9B:
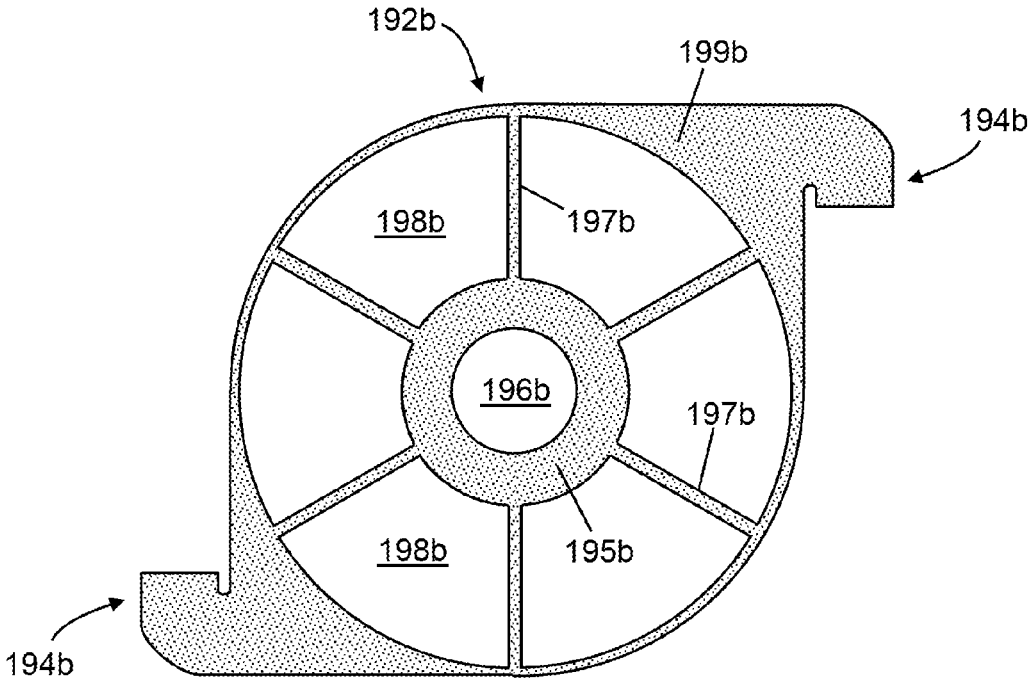

FIGS. 9A-9B are respective depictions of two separate electrode structures or electrode-bearing structures of an alternative set of such structures. The electrode plate structures 192*a*, 192*b* illustrated in FIGS. 9A-9B, may be considered as two examples of electrode plates which may be stacked, similarly to the stacking arrangement shown in FIG. 8A, within an ion transport apparatus as taught in U.S. Pat. No. 8,907,272 and as may be employed in systems in accordance with the present teachings. Such an ion transport apparatus will generally comprise a plurality of electrode plate structures, of which the two illustrated electrode plate structures 192*a*, 192*b* are representative. Within such an apparatus, the electrode plate structure 192*a* is positioned relatively closer to an ion entrance and the electrode plate structure 192*b* is positioned relatively closer to an ion exit. As described previously in regard to FIG. 8A, the central apertures (central apertures 196*a*, 196*b* as well as corresponding apertures in other of the associated plurality of electrode plate structures) together form an ion channel through which ions are transmitted, with the diameter of the channel decreasing from the ion entrance to the ion exit. Also, as previously described in regard to FIG. 8A, the other apertures (apertures 198*a* in FIG. 9A, apertures 198*b* in FIG. 9B as well as corresponding apertures in other of the associated plurality of electrode plate structures) are employed, in operation, to channel neutral gas molecules through the apparatus so that the gas may be exhausted from the ion transport apparatus spatially separated from the ions.

Each electrode plate structure (e.g., electrode plate structures 192*a*, 192*b*) may be formed as a single integral piece of an electrically conductive material, such as a metal. In such cases, the central apertures 196*a*, 196*b* and the other, outer apertures (other apertures 198*a* in FIG. 9A and 198*b* in FIG. 9B separated by respective spoke portions 197*a* and 197*b* and surrounded by outer rings 199*a*-199*b*, respectively) may cut out of a pre-form metal plate by any suitable mechanical, chemical, electrical, optical or electro-chemical machining technique, such as, by way of non-limiting example, by mechanical cutting, mechanical stamping, laser cutting, chemical etching, etc. As illustrated in FIGS. 9A-9B, the plates may comprise integral tab structures (or other structures) that may be used for mounting each of the plurality of electrode plates within a respective slot of a housing member (not shown) of the ion transport apparatus. The tabs may also be additionally or alternatively employed as electrical connectors. For example, assuming that the each of the plates 192*a*, 192*b* comprises a single integral piece of metal, the tabs 194*a*, 194*b* may be folded around and welded to a respective electrical contact of the housing member.

A subset of a plurality of electrode plates adjacent to the ion exit of an ion transport apparatus may comprise a set of ring electrodes (e.g. ring electrode 195*b* in FIG. 9B) wherein these ring electrodes adjacent to the ion exit have a constant outer diameter among the subset of the plurality of plates. Within this subset, the widths of the ring electrodes increase in a direction towards the ion exit of the apparatus as the diameter of the central apertures become smaller at the same time that the ring electrode outer diameters (defined by the inner boundaries of the other apertures such as apertures 198*b*) remain constant. For example, the increase in the width of the ring electrodes may be noted by comparing the width of ring electrode 195*b* in electrode plate 192*b* to that of ring electrode 195*a* in electrode plate 192*a*. Such a configuration is advantageous for optimizing the separation of ion flow (through central apertures 196*a*, 196*b*, etc.) from the flow of gas (through the other apertures 198*a*, 198*b*, etc.) and thereby minimizing the transport of gas into the lower-pressure chamber into which the ions are directed after passing through the ion exit of the apparatus.

Figure 9C:
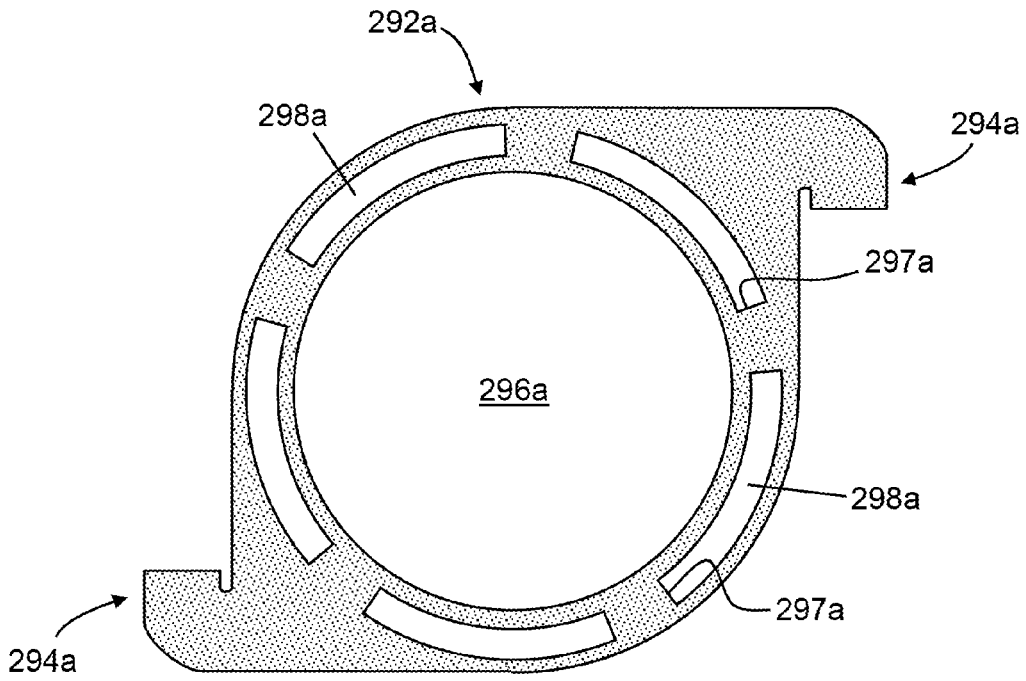
FIGS. 9C-9D are respective depictions of two separate electrode structures or electrode-bearing structures that may be included as part of a still further alternative set of such structures in the ion transport apparatus of FIG. 8A.
Figure 9D:
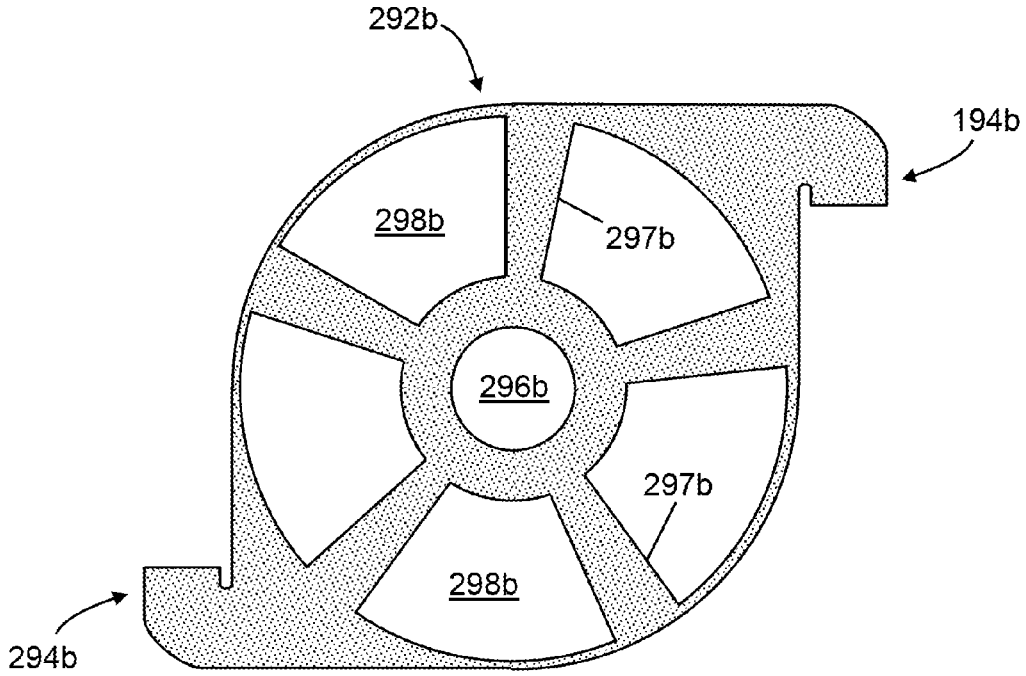
Figure 9E:
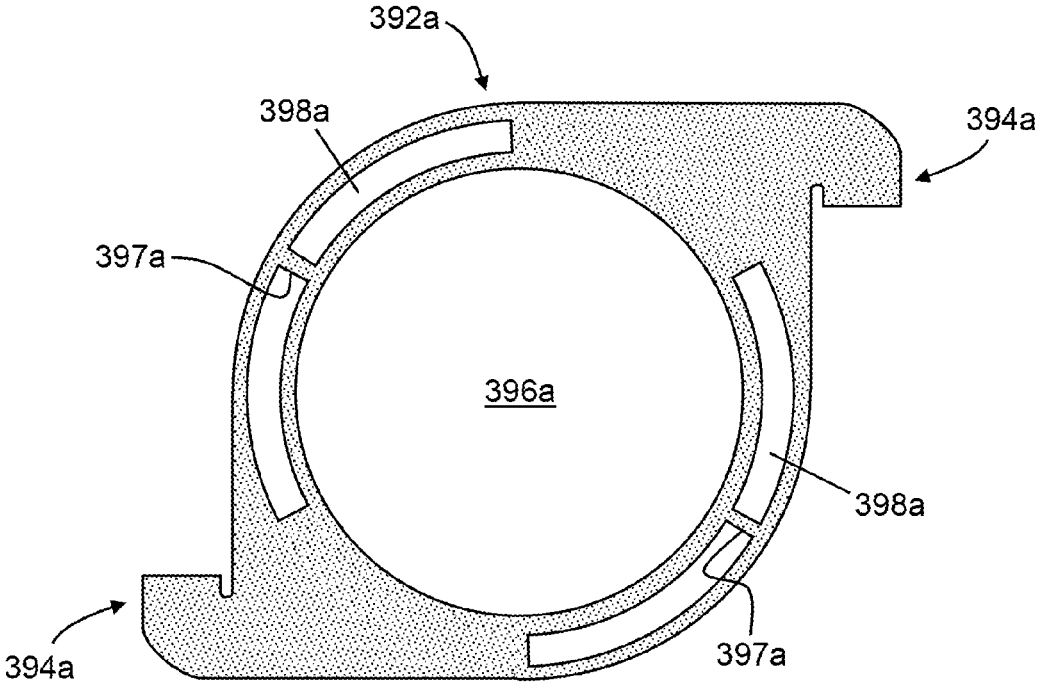
FIGS. 9E-9F are respective depictions of two separate electrode structures or electrode-bearing structures that may be included as part of a yet still further alternative set of such structures in the ion transport apparatus of FIG. 8A.
Figure 9F:
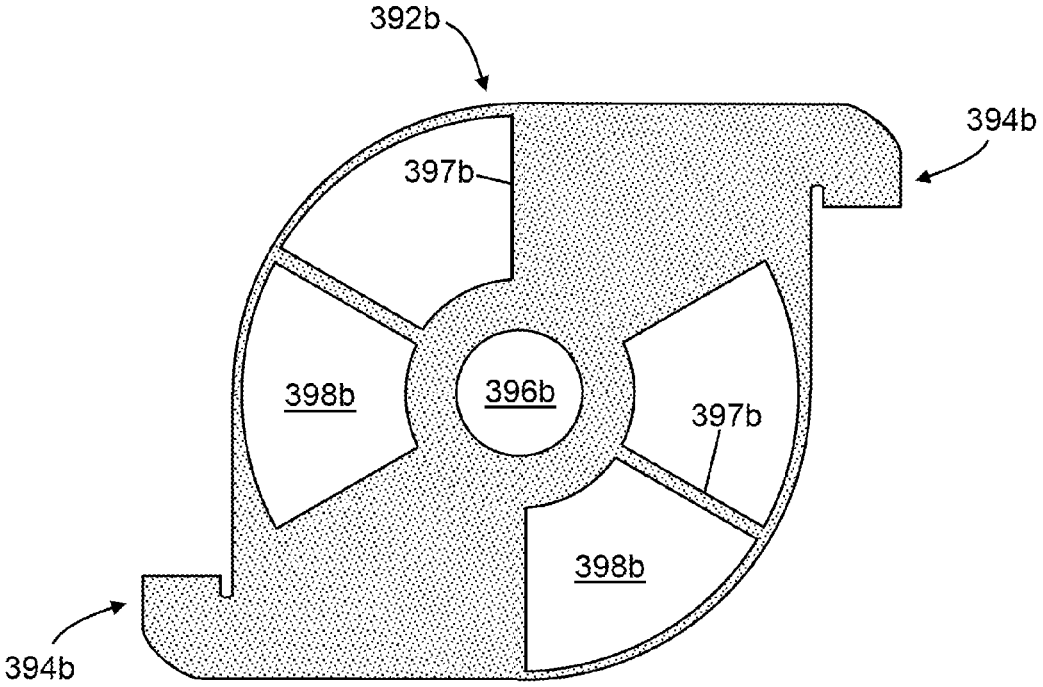

In alternative embodiments (for example, one embodiment as illustrated in FIGS. 9C-9D and another embodiment as illustrated in FIGS. 9E-9F), the outer apertures may occupy a smaller portion of the surface area of one or more of the electrode plate. The areal extent of the electrode plates occupied by the open outer aperture sections may be designed so as to fine tune (e.g., regulate) the conductance (or even the directionality of the conductance) of the gas perpendicular to the axis. For example, in FIGS. 9C-9D, two electrode plates 292*a*, 292*b* out of a set of plates are shown and in FIGS. 9E-9F, two electrode plates 392*a*, 392*b* out of an alternative set of plates are shown. The electrode plates 292*a*, 292*b* shown in FIGS. 9C-9D respectively comprise central apertures 296*a*, 296*b*, respectively comprise outer apertures 298*a*, 298*b*, respectively comprise spoke portions 297*a*, 297*b* and respectively comprise tab sections 294*a*, 294*b*. Similarly, the electrode plates 392*a*, 392*b* shown in FIGS. 9E-9F respectively comprise central apertures 396*a*, 396*b*, respectively comprise outer apertures 398*a*, 398*b*, respectively comprise spoke portions 397*a*, 397*b* and respectively comprise tab sections 394*a*, 394*b*.

One method for reducing the areal extent of the outer apertures—through which gas flows—would be to simply retain the same number of apertures while making each aperture smaller. Another method for reducing the areal extent of the outer apertures is as shown in the example of FIGS. 9C-9D, in which the number of equally-spaced-apart outer apertures is reduced (from six apertures to five apertures per plate) but the size of the apertures remains unchanged, with respect to the outer apertures 198*a*, 198*b* shown in FIGS. 9A-9B. Yet a third method for reducing the areal extent of the outer apertures is as shown in FIGS. 9E-9F, in which the number of apertures is reduced but the apertures are not equally spaced. This latter configuration would be beneficial for cases in which the delivery of ions into ion transport apparatus having the electrode plates 392*a*, 392*b* (and others) is not axisymmetric or is not aligned with respect to the axis of the ion channel. Such would be the case, for instance, if an ion transfer tube that inputs the ions makes a small angle relative to the axis of the device (as in FIG. 7) or if the bore of the ion transfer tube is not circular in cross section or if the ion transfer tube includes multiple bores. In these situations, the relative positions of the apertured and non-apertured sections of the electrode plates would be chosen in accordance with the direction or the asymmetry of the gas jet or jets being input to the apparatus.

Figure 10A:
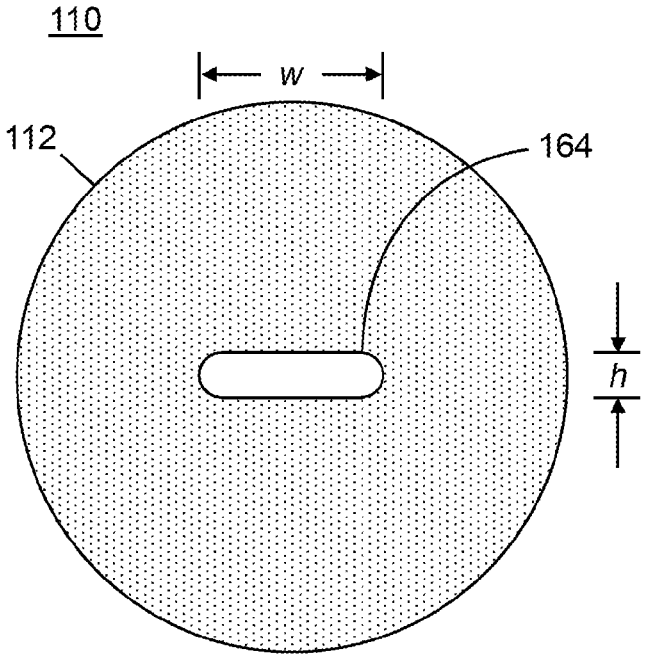
FIG. 10A (Prior Art)
FIG. 10A is a cross sectional view an ion transfer tube as may be employed in accordance with various embodiments of the instant teachings.

FIG. 10A is a cross sectional view of a portion of a slotted ion transfer tube, ion transfer tube 110, as may be employed in accordance with various embodiments of the instant teachings. Such slotted ion transfer tubes are discussed in greater detail in U.S. Pat. No. 8,309,916 in the names of inventors Wouters et al., issued on Nov. 13, 2012 and assigned to the assignee of the instant application. In this example, the slot 164 in the tube material 112 has been formed (for example, by wire-EDM, wire erosion, etching or abrasion) in diametrically outward directions, from an originally circular cross section bore of 580 μm diameter so as to create a "letterbox" like shape—with rounded corners—having a width, w (along the elongated direction), of 1.25 mm and a height, h, of 580 μm. For example, as indicated by the arrows in FIG. 10B, the slot 164 may be formed by etching or eroding (e.g., by the wire-EDM technique) auxiliary channels 144 outward from a pre-existing central circular bore hole 143 within a tube 142. A slot of the above-noted size conveniently fits within the 1/16" outer diameter of commonly available stock tubing. The ratio, R, between the area of the novel slotted bore 164 and the standard circular bore is $$R = \frac{\pi(580/2)^2 + (1250 - 580) \times 580}{\pi(580/2)^2} = 2.47x. \quad \text{Eq. 2}$$

The steady state chamber pressure of an evacuated chamber into which gas is introduced through an ion transfer tube may be taken as a measure of the throughput of the tube. Accordingly, the respective throughputs of three different ion transfer tubes used as inlets to a chamber were compared by observing the chamber pressures obtained with a two-stage mechanical pump having a pumping capacity of 30 $m^3$/hr, and operated in a choked flow regime (all tubes the same length). The results show that, as expected, the chamber pressure scales in direct proportion to the bore cross-sectional area for the two tubes having circular bores. Moreover, with regard to the present discussion, it is also to be noted that, within experimental error, the ratio of pressures observed in comparison of the slotted-bore tube having bore lobe height of 580 μm to the circular-bore tube having 580 μm also scales in direct proportion to the area ratio as calculated in Eq. 2 above. To achieve throughput comparable to that of the obround-bore tube, a circular-bore tube having a bore diameter of 911 μm would be required.

One benefit of using an obround or slotted bore (i.e., a so-called "letterbox" bore shape) is that the one of the dimensions of the rectangular cross section can be kept relatively small, i.e. similar to the maximum useable diameter in case of a tube with circular inner bore so to maintain sufficient desolvation, whereas the other dimension (i.e., the width) can be much larger so as to increase the throughput of ion laden gas from the API source and thereby increasing the sensitivity of the mass spectrometer system. Some charged droplets passing through the center of such a conventional single bore tube would be as far as 455 μm away from a heat-providing tube wall as compared to the maximum distance of 290 μm experienced by droplets passing through the tube with the obround bore. The obround-bore tube is therefore expected to provide more complete desolvation than a circular-bore tube of similar length having the same bore cross-sectional area. Equivalently, the obround-bore tube is expected to, in general, provide greater throughput than and equivalent desolvation to a circular-bore tube having a diameter equal to the minimum distance across (i.e., the height of, in the present example) the obround channel.

Figure 11A:
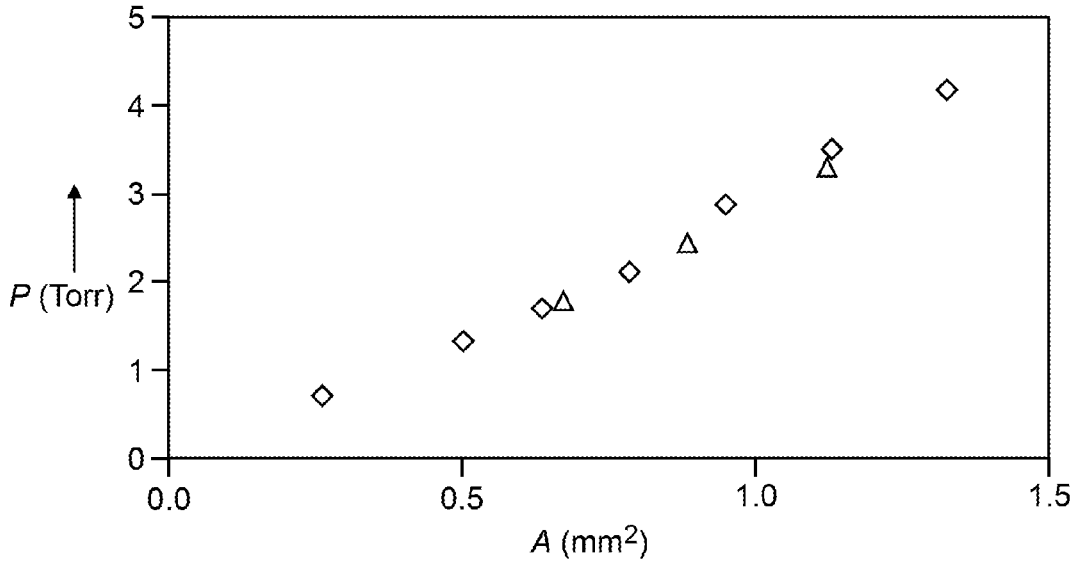
FIG. 11A is a graph of gas pressure measured in an ion funnel receiving gas and ions from ion transfer tubes of two different types plotted against the tube bore cross sectional area, where diamond symbols and triangle symbols represent, respectively, measurements conducted with conventional round-bore ion transfer tubes and measurements conducted with obround- or slotted-bore ion transfer tubes.
Figure 11B:
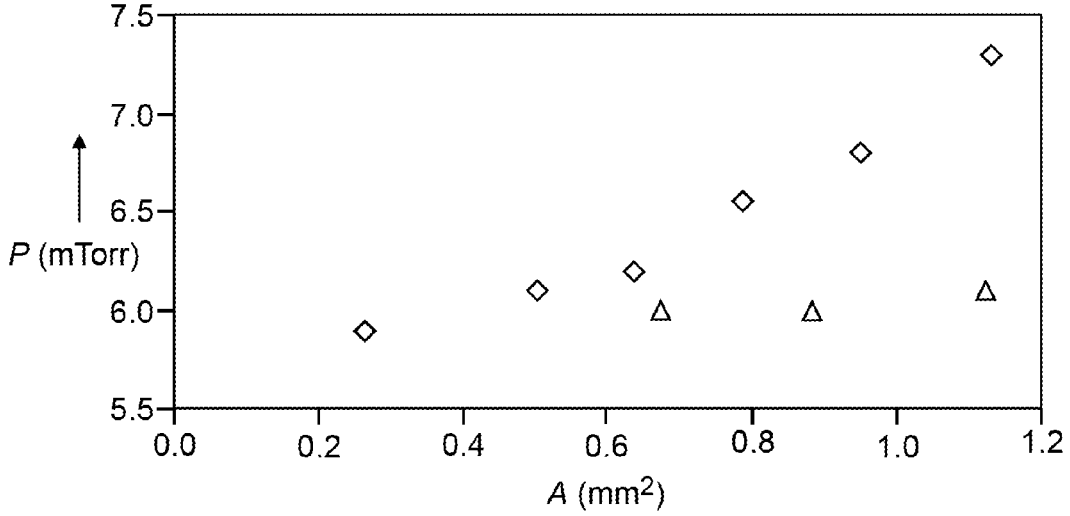
FIG. 11B is a graph of gas pressure measured in a low pressure chamber receiving ions from the ion funnel employed in the measurements depicted in FIG. 11A, where the diamond and triangular symbols have the same meanings as in FIG. 11A.

FIGS. 11A and 11B are graphs of measured internal gas pressure plotted against the tube bore cross sectional area. FIG. 11A illustrates pressure measured within a conventional ion funnel apparatus and FIG. 11B illustrates pressure measured in a downstream analyzer chamber that is evacuated to a lower pressure than the chamber within which the ion funnel is located. In both FIGS. 11A-11B, diamond symbols relate to pressure measurements obtained in a system employing conventional round-bore ion transfer tubes and triangle symbols relate to pressure measurements obtained in a system employing obround- or slotted-bore ion transfer tubes. The x-axis in both of FIGS. 11A and 11B represents tube bore cross sectional area. In the case of round-bore tubes, a number of tubes were employed in which the inner diameter was increased stepwise from 0.58 mm to 1.4 mm. In the case of slotted tubes, the height (h) and width (w) dimensions (see FIG. 10A) of different tubes spanned the range of 0.58-0.6 mm and 1.25-2.0 mm, respectively. The gas-flow throughput of the two types of ion transfer tubes ranges from a factor 2.0 times greater to 5.6 times greater than the throughput of a standard 0.58 mm diameter round bore ion transfer tube.

The correlation between increasing the gas-flow throughput of the ion transfer tube and the internal chambers is well illustrated in FIGS. 11A-11B. The results for the round-bore ion transfer tubes exhibit an undesirable rapid increase in the analyzer chamber pressure indicating excessive overflow of gas across the multiple pumping stages (e.g., FIGS. 1A-1B) and into the analyzer chamber. One possible way of dissipating the gas pressure in the ion funnel chamber would be to increase the length of the funnel (e.g., from 54 mm to 130 mm) so as to provide sufficient distance for the jetting gas streamlines to dissipate energy and divert towards the intermediate-pressure chamber exhaust line (e.g., port 31 in FIGS. 1A-1B). With the bulk of the gas load removed in this fashion, it has been observed that the pressure in each of the pumping stages, including the analyzer region, could be restored to an optimal range.

Although increasing the length of the funnel (or other multi-electrode ion transport device such as a stacked ring ion guide) can serve as a means of maintaining pressure in each of the pumping stages in an optimal range without increasing in the number of pumping stages or pumping capacity, it is not the best solution. The increased length of the ion transport device can have the undesirable effect of increasing overall device size and footprint. Moreover, the capacitance of such a device will be increased, thus placing limitations on the magnitude of RF power that can be supplied to the device.

To address the above issues, the inventors have realized that the results shown in FIG. 11B reveal a preferable way to manage the gas load. Specifically, it is observed that the use of a slotted-bore ion transfer tube does not cause significant pressure increase in the analyzer chamber with increasing gas throughput. The pressure in the analyzer chamber is thus significantly lower than that observed for a round-bore ion transfer tube having comparable throughput. This suggests that by using an ion transfer tube with a slotted bore, the mass flux of the incoming gas is greatly reduced to downstream mass spectrometer chambers. As a result, the use of a slotted-bore ion transfer tube allows the use of a short (e.g., 54 mm) electrodynamic ion funnel.

Figure 12:
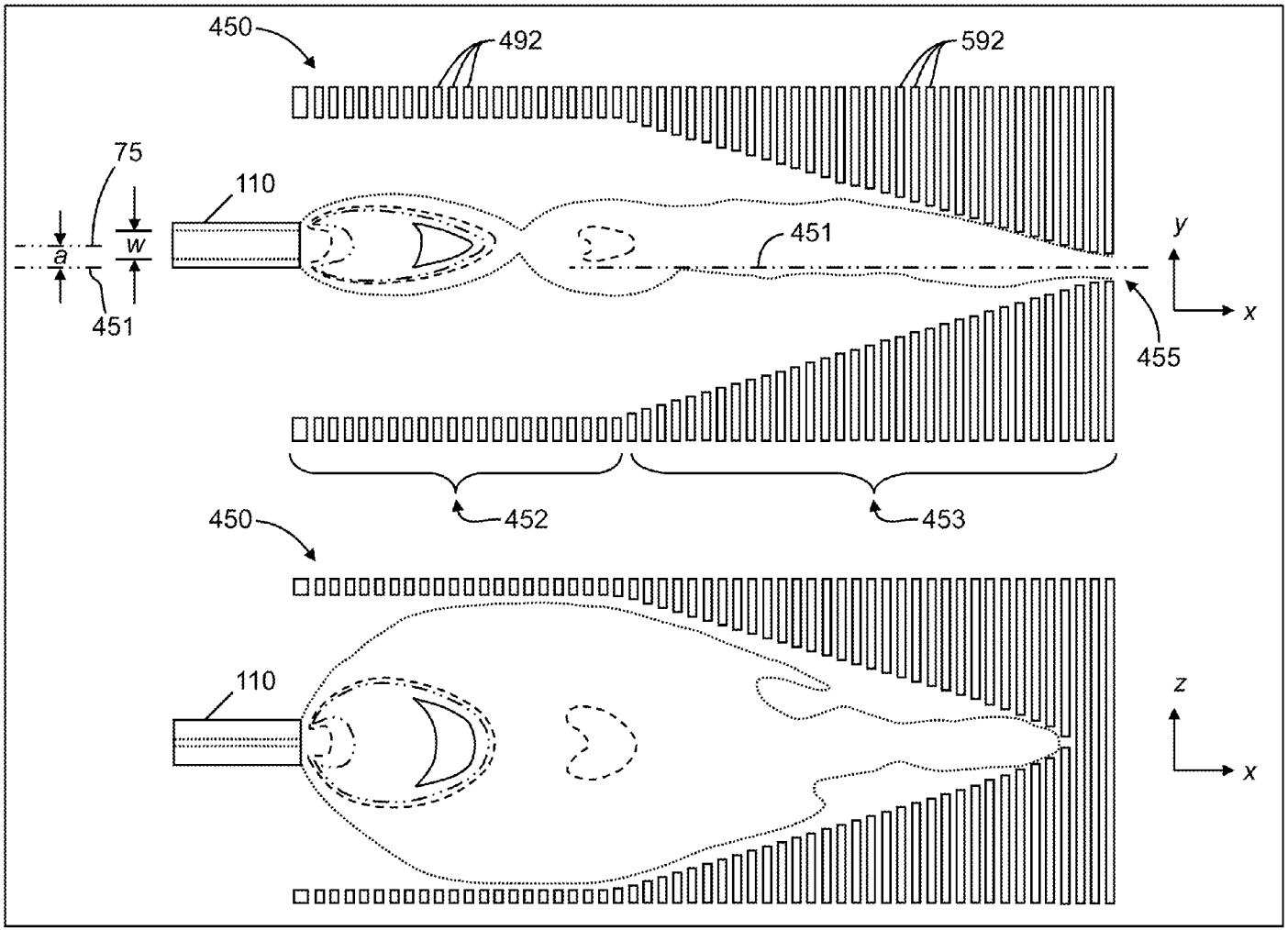
FIG. 12 is a set of two-dimensional contour plots showing the gas flow profile of gas emerging from an ion transfer tube having a bore with an obround or slotted cross section and into an electrodynamic ion funnel in the YX (top frame) and ZX plane (bottom frame)

The correlation between the shape of the bore of the ion transfer tube and the moderation of pressure increase with increasing gas throughput was treated as a novel property and was studied in detail with computational fluid dynamics. FIG. 12 shows the results of these calculations. The extended ion funnel 450 illustrated in FIG. 12 comprises a first portion 452 that includes a set of electrode plates 492 all having central apertures of the same diameter and a second portion 453 in which the diameters of the electrode plates 592 progressively decrease in diameter towards an ion exit 455. The length of the first portion 452 of the ion funnel 450 provides a minimum lateral distance between the ion transfer tube 110 and the tapering-aperture-diameter second portion 453 such that the forward velocity of the ion laden gas is sufficiently lowered by collisions with background gas within the first portion 452. When the forward velocity of the ion laden gas has been sufficiently lowered in the first portion, it becomes possible to manipulate the ions with radio frequency electric fields with low enough amplitudes to be below the Paschen breakdown limit in the second portion, such that the ions may be preferentially guided and focused towards the ion exit 455.

The top frame of FIG. 12 shows the propagation of the Mach disc within the ion funnel 450 along the x-y plane (i.e., a "side view" of the apparatus) and the bottom frame of FIG. 12 shows the propagation of the Mach disc within the x-z plane (i.e., a "top view") as delivered into the ion funnel from a slotted-bore ion transfer tube 110. Note that, in the embodiment shown in FIG. 12, the x-direction is defined as being parallel to the central axis 451 of the ion funnel. Note also that, in the embodiment shown in FIG. 12, the long dimension or width, w, of the slot of the ion transfer tube 110 is oriented parallel to the x-y plane and that the axis 75 of the ion transfer tube is parallel to the funnel axis 451 but offset from it by a distance, α. Although the overall behavior of the gas expansion in the (upper frame of FIG. 12) was anticipated, the x-z plane (lower frame) shows a surprising radial expansion of the Mach disc which is not seen in the x-y plane. A reconstruction of the computational fluid dynamics data in three-dimensional space (not shown) reveals that the Mach disc originating from the slotted-bore ion transfer tube 110 is asymmetrical in shape. The asymmetry causes a radial dispersion of the gas streamlines away from center axis, towards the edges of the RF electrodes, and reduces the flux of gas molecules going into the downstream pumping stages through the ion exit 55. This explains the limited increase in the analyzer pressure when compared to a round bore capillary at comparable throughput. In contrast, the Mach disk arising from a round bore ion transfer tube is symmetrical (not shown) and, in that case, the bulk of the gas flux is collimated along or parallel to the center axis 51 such that an undesirable proportion of the gas may pass towards and through the ion exit 55.

Figure 13A:
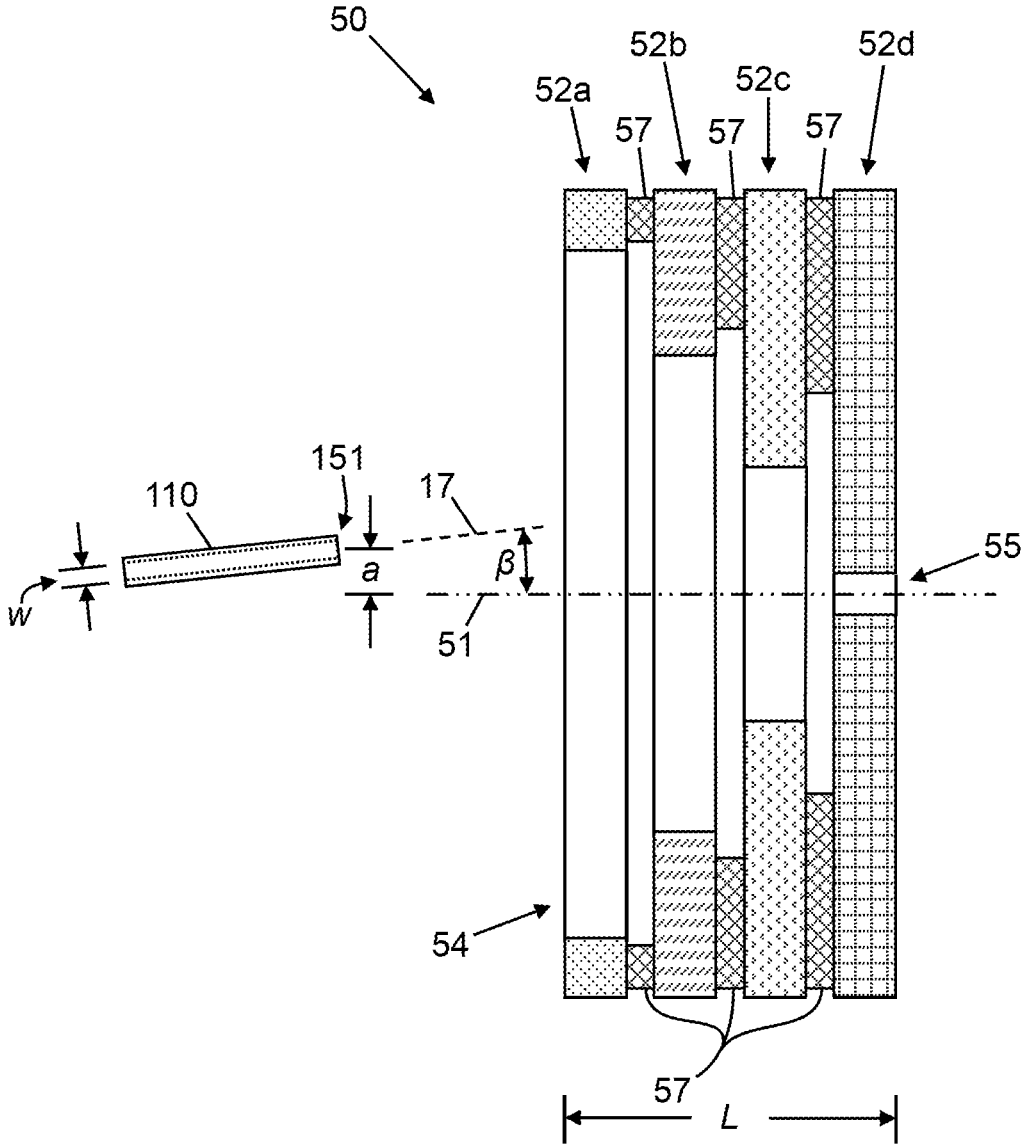
FIG. 13A is a schematic depiction of a system, in accordance with the present teachings, that includes an ion transfer tube having a bore with an obround or slotted cross section interfaced to a conventional electrodynamic ion funnel apparatus.

FIG. 13A is a schematic depiction of a system, in accordance with the present teachings, that includes an ion transfer tube 110 having a bore with an obround or slotted cross section that is interfaced to an electrodynamic ion funnel apparatus 50. FIG. 13A may also be considered to depict a method, in accordance with the present teachings, of interfacing an ion transfer tube having a bore with an obround or slotted cross section to an electrodynamic ion funnel apparatus. For purposes of comparison, the ion funnel apparatus 50 is depicted in similar schematic fashion in both FIG. 3 and FIG. 13A. As noted previously, a central axis 51 of the funnel, which is also an ion channel axis, may be defined such that the axis 51 passes through the center of the largest aperture 54, which corresponds to an ion entrance of the funnel, and also through the smallest aperture 55, which corresponds to an ion exit. A longitudinal central axis 17 may also be defined for the ion transfer tube 110. The funnel axis 51 and the ion transfer tube axis 17 together define a geometric plane that contains both of these axes.

In the system shown in FIG. 13A, an outlet end 151 of the ion transfer tube 110 may be disposed offset from the funnel axis 51 by an offset distance, α. Alternatively, the axis 17 of the ion transfer tube may be disposed at a non-zero angle, β, from the axis 51 of the ion funnel and of the corresponding ion channel. Still further alternatively, the outlet end outlet end 151 may be offset from the funnel axis at the same time that the ion transfer tube axis makes an angle (not equal to zero) with the funnel axis. The so-defined spatial offset, angular offset, or combined spatial and angular offsets cause the trajectories of neutral gas molecules that emerge from the outlet end 151 of ion transfer tube 110 to be such that these trajectories do not project through the ion funnel exit end 55. As noted previously and as shown in FIG. 10A, the ion transfer tube has a slot 164 having a width, w, taken along the elongated direction of the slot. In the system shown in FIG. 13A, the ion transfer tube is disposed such that this elongated slot direction is within the geometric plane defined by the funnel axis 51 and the ion transfer tube axis 17.

Figure 13B:
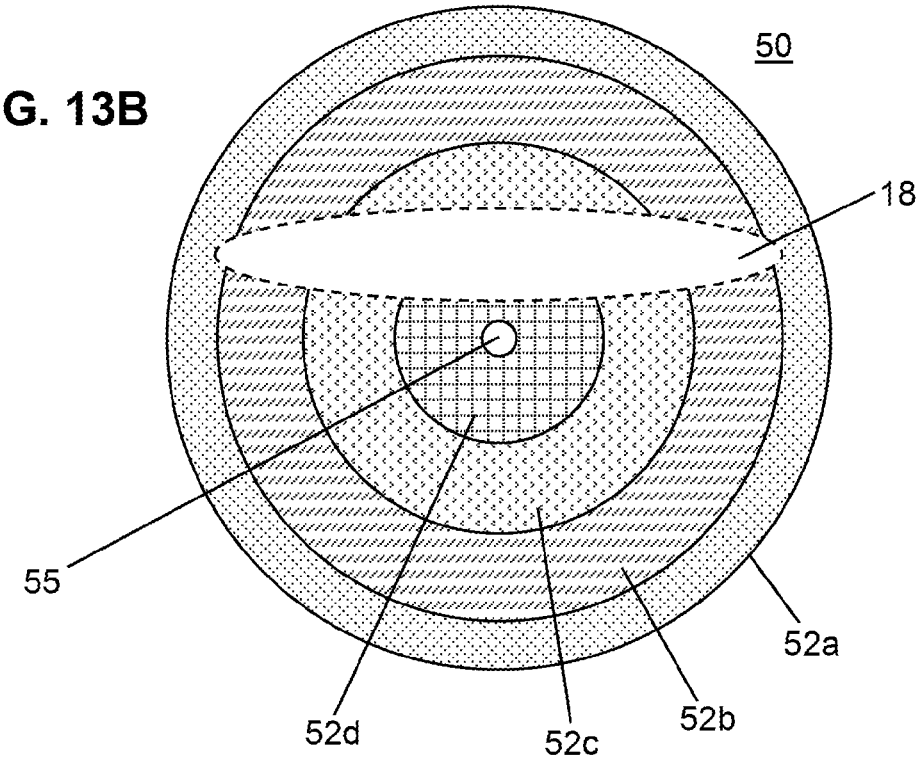
FIG. 13B is an end-on view of the various electrodes of an ion funnel showing a primary zone of impingement of gas onto the electrode surfaces when ions are supplied to the ion funnel by means of an ion transfer tube having an obround or slotted bore.

FIG. 13B is an end-on view of the various electrodes of an ion funnel 50 showing the primary zone of impingement 18 of gas onto the electrode surfaces when ions are supplied to the ion funnel as shown in FIG. 13A. The elongated shape of the zone 18, which is a result of the asymmetric plume shape depicted in FIG. 12, has been confirmed by experiment by observing burned-on deposited films (tarnish) on used electrode surfaces. The orientation of the elongated zone of impingement within the funnel, as shown in FIG. 13B, is a result of the geometric relation between the ion transfer tube 110 and the ion funnel, as discussed above with reference to FIG. 13A. Preferably, the angle β and the offset α, as shown in FIG. 13A, are chosen such that, for a given length, L, of the ion funnel, the primary zone of gas impingement 18 does not coincide or overlap with the ion exit 55. Thus, in this fashion, the gas flow is effectively diverted away from the ion exit.

Figure 13C:
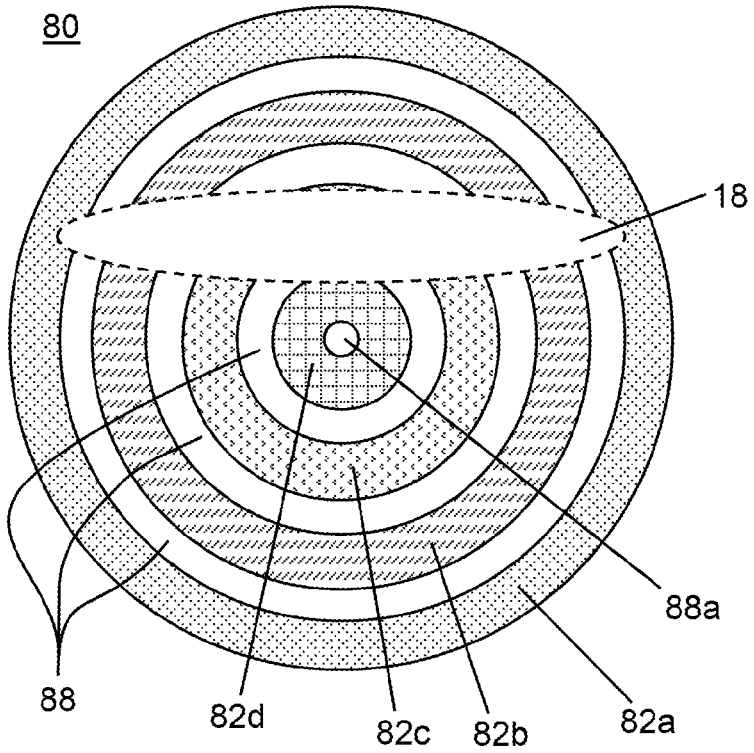
FIG. 13C is an end-on view of the various electrodes of an ion transport apparatus comprising an open geometry funnel having gas-exhaust gaps between ring electrodes or gas-exhaust apertures in electrodes showing a primary zone of impingement of gas onto the electrode surfaces when ions are supplied to the ion funnel by means of an ion transfer tube having an obround or slotted bore.

A similarly shaped primary zone of impingement is expected when such an ion transfer tube in used in conjunction with various other ion transport apparatuses taught in this document, such as those shown in FIG. 5A, FIG. 5C, FIG. 6, FIG. 7 and FIG. 8A. Accordingly, FIG. 13C shows, as but one example, the expected shape of the primary zone of gas impingement 18 when used with the apparatus 80, which was previously described in conjunction with FIG. 7. The combined effects of the plume shape and the geometric relation between the ion transfer tube and the ion funnel cause the primary zone of gas impingement 18 to fail to coincide the ion exit which, in the case of the apparatus 80 shown in FIG. 13C, corresponds to the aperture 88*a* in the electrode that is closest to the axis (electrode 82*d*). Nonetheless, the primary zone of impingement 18 overlaps several of the plurality of open gaps 88 that are provided by gas-exhaust apertures in electrodes other than electrode 82*d*. Gas which passes through the open gaps 88 will escape from the interior volume of the ion funnel 80 and will be purged from the chamber containing the ion funnel without causing significant pressure increase within the ion funnel or the chamber. In alternative embodiments, the gaps or gas exhaust apertures may be shaped, oriented or otherwise spatially disposed so as to align with or to spatially overlap with or match the zone of primary gas impingement so as to most efficiently divert gas flow away from the ion exit. Alternatively, the ion transfer tube may be oriented or otherwise spatially disposed such that the zone of primary gas impingement generated by gas emergent from the ion transfer tube aligns with or spatially matches a given set of gaps or apertures through which gas is exhausted. As noted in the above discussion relating to FIG. 12, the orientation of the zone of primary gas impingement is related to the angular and spatial orientation of ion transfer tubes having slotted or obround bores.

In some situations, the ion transport apparatus 80 could include at least some electrode plates having outer apertures for gas exhaust that are unevenly or asymmetrically distributed across the plane of the electrode plate, similar to the examples shown in FIGS. 9E-9F. The outer apertures may be disposed at a position and of a shape so as to strongly overlap with and or match the location and shape of the primary zone of impingement 18. Thus, a system configuration (similar to that shown in FIG. 13A) which employs both a novel ion transport apparatus as taught herein (such as those shown in FIG. 5A, FIG. 5C, FIG. 6, FIG. 7 and FIG. 8A) as well as an ion transfer tube having an obround or slotted bore is expected to be especially effective in exhausting gas load from intermediate pressure chambers and preventing buildup of gas pressure in downstream analyzer chambers.

Figure 13D:
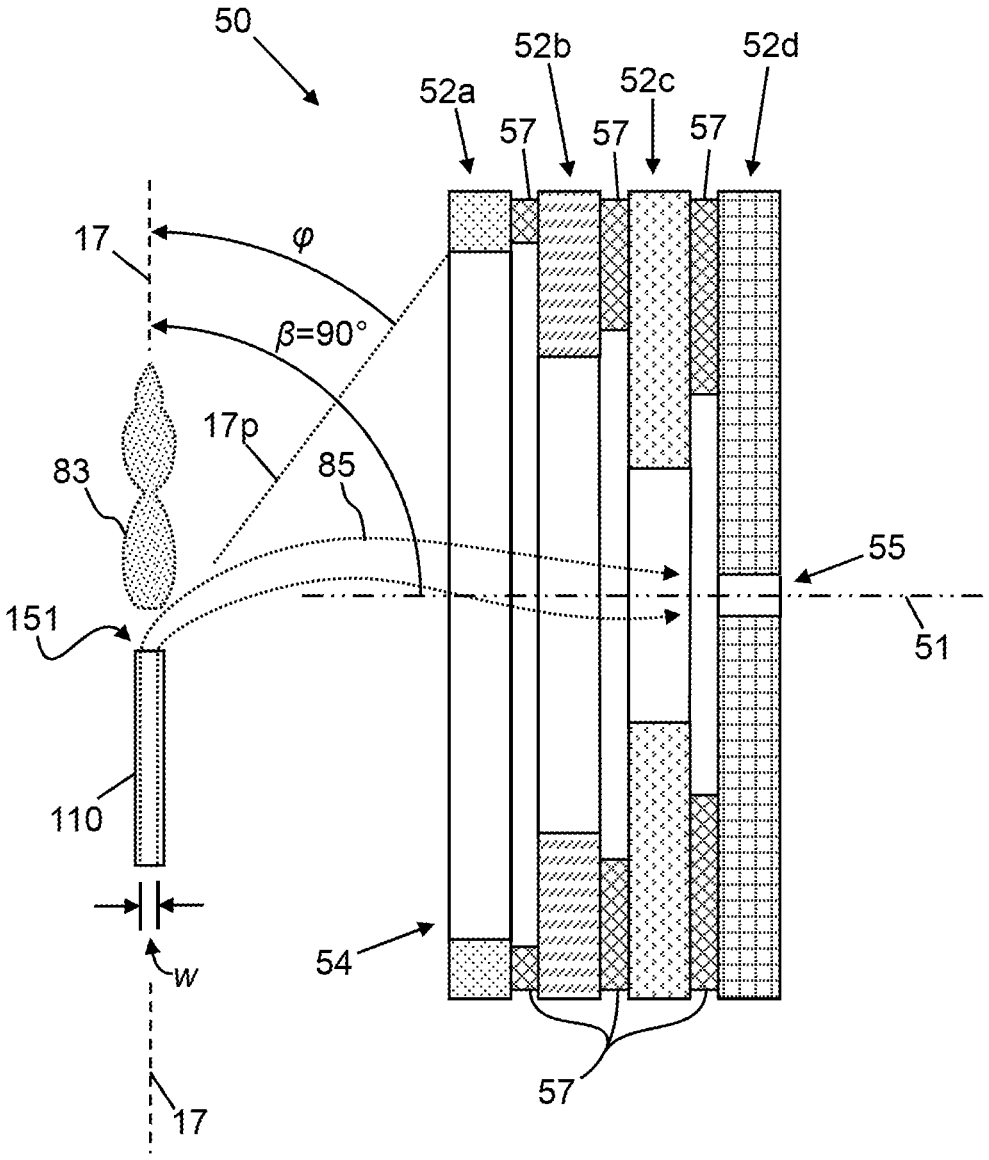
FIG. 13D is a depiction of an alternative system, in accordance with the present teachings, that includes an ion transfer tube having a bore with an obround or slotted cross section interfaced to an electrodynamic ion funnel apparatus.

FIG. 13D is a depiction of an alternative system, in accordance with the present teachings, that includes an ion transfer tube 110 having a bore with an obround or slotted cross section that is interfaced to an electrodynamic ion funnel apparatus 50. FIG. 13D may also be considered to depict an alternative method, in accordance with the present teachings, of interfacing an ion transfer tube having a bore with an obround or slotted cross section to an electrodynamic ion funnel apparatus. Similarly to the configuration illustrated in FIG. 13A, the longitudinal axis 17 of the ion transfer tube 110 and the central axis 51 of the ion funnel 50 define a geometric plane, where the central axis 51 can also be described as an ion channel axis, where the ion channel is identical to the funnel-shaped ion transport region. Further, the elongated direction of the slot (depicted in FIG. 13D by the width, w) of the ion transfer tube 110 is within such plane. In contrast to the system shown in FIG. 13A, the longitudinal axis 17 of the ion transfer tube 110 makes an angle, β, of substantially ninety degrees with respect to the central axis 51 of the ion funnel 50 within the alternative system shown in FIG. 13D. As a consequence, the elongated direction of the slot (depicted in FIG. 13D by the width, w) is disposed substantially parallel to the ion funnel axis 51 in the system shown in FIG. 13D. As a result of the distinctive flow characteristics associated with gas emerging from the ion transfer tube 110 (FIG. 12), the configuration shown in FIG. 13D yields a gas plume 83 that emerges from the ion transfer tube with expansion along the axis 17 as well as out of the plane of the drawing but without significant gas flow in the direction of the ion funnel. By contrast, the ions are diverted away from the gas expansion directions along ion pathways 85 by an axial field provided by the ion funnel. The ion funnel in FIG. 13D could be replaced by an alternative ion transport apparatus as taught in this document, such as those shown in FIG. 5A, FIG. 5C, FIG. 6, FIG. 7 and FIG. 8A.

FIG. 13D illustrates a ninety-degree angle between the ion funnel axis 51 and the ion transfer tube axis 110, this angle being taken as positive, for purposes of this discussion, as measured in a counterclockwise direction from the positive end of the funnel axis 51 to the positive end of the axis 17 of the ion transfer tube. For purposes of this discussion, the positive end of the funnel axis 51 is taken as being on the funnel side of the outlet end 151 of the ion transfer tube 110 and, similarly, the positive end of the axis 17 of the ion transfer tube is taken as being on the gas plume side of the outlet end 151. In practical applications, a range of angles are possible, however. Angles greater than ninety degrees are not practical, since ions emerging from the ion transfer tube 110 would initially propagate away from the ion funnel. Angles less than ninety degrees could, however, be employed. A practical minimum value for this angle, as defined above, between the ion funnel axis and the ion transfer tube axis, is, in degrees, (90°-ϕ°), where the angle ϕ is defined as being the angle at which, when subtracted from 90°, causes the extended axis 17*p* of the ion transfer tube to just encounter the edge of the largest aperture 54 of the ion funnel without projecting into the aperture 54 (see FIG. 13D).

Figure 14A:
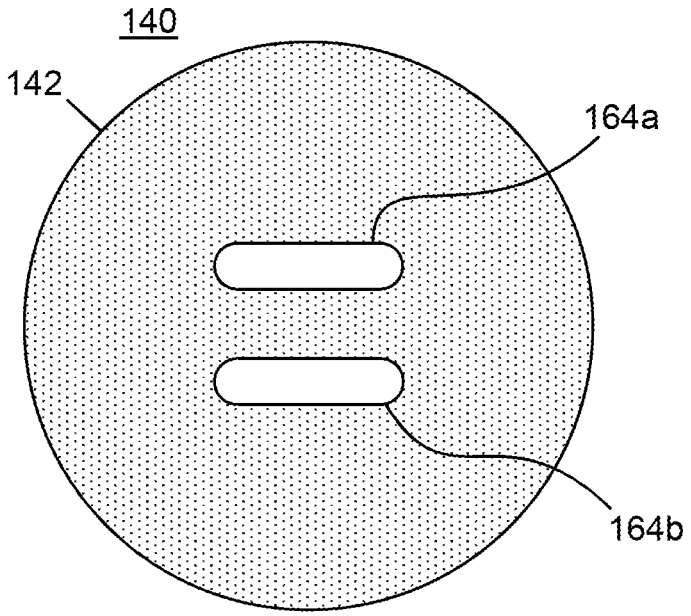
FIG. 14A (Prior Art)
FIG. 14A is a cross sectional view of a second ion transfer tube as may be employed in accordance with various embodiments of the instant teachings.

FIG. 14A is a cross sectional view of another ion transfer tube that may be employed in accordance with various embodiments of the instant teachings. The ion transfer tube 140 illustrated in FIG. 14A comprises multiple distinct separated obround bores or slots 164*a*, 164*b* in tube material 142. Although two such bores are illustrated in FIG. 14A, the number of bores within a particular ion transfer tube need not be limited to any particular number. Such a multiple-bore ion transfer tube may be employed to capture charged particles emitted by a two-dimensional emitter array. The multiple-bore ion tubes may also capture charged particles emitted by separate emitter arrays—for example, two linear emitter arrays—perhaps receiving sample material from respective separate sample sources. As another example, different bores could be used concurrently in order to transport different respective analytes or substances (e.g., one obround bore may be used mainly for analyte, while a different one is used for an internal calibrant).

Figure 10B:
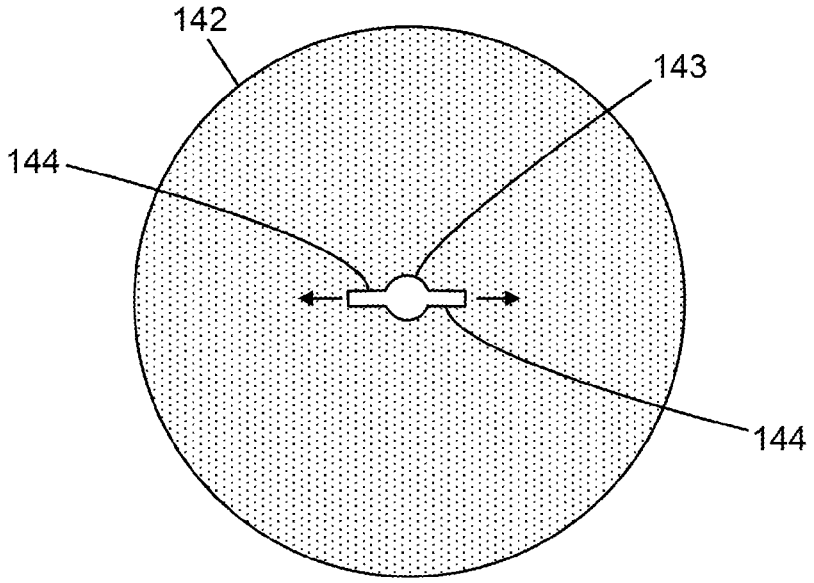
FIG. 10B (Prior Art)
FIG. 10B is an illustration of steps in a method for forming an ion transfer tube having a slotted bore.
Figure 14B:
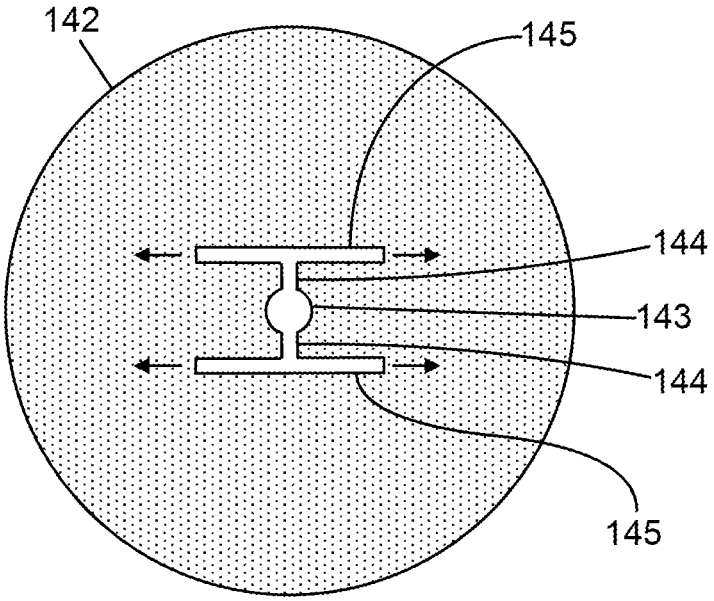
FIG. 14B (Prior Art)
FIG. 14B is an illustration of steps in a method for forming an ion transfer tube having multiple slotted bores.

The multiple tube bores illustrated in FIGS. 14A may be formed by wire-EDM erosion (or other erosion or abrasion technique) outward from separate pre-existing through-going circular bores of a pre-existing tube. For instance, the pre-existing tube may be a commercially available tube having multiple circular bores. If a suitable pre-existing multi-bore tube is not commercially available, then one may be fabricated by drilling multiple bore holes through a solid cylinder. Alternatively, a tube, such as the multiple-bore ion transfer tube 140 shown in FIG. 14A, may be fabricated starting with a conventional tube having a single central bore 143, as illustrated in FIG. 14B. A first step, as previously illustrated in FIG. 10B, is to etch or erode (e.g., by the wire-EDM technique) auxiliary channels 144 outward from the pre-existing central circular bore hole 143 within a tube 142, as indicated by the arrows in FIG. 10B. The ends of the auxiliary channels 144 then serve as starting points for etching or erosion of additional channels 145, as shown by the arrows in FIG. 14B. Further enlargement (if desired) of the channels 145 then yields the slots 164*a*, 164*b* as shown in FIG. 14A. The auxiliary channels 144 could be formed in some other directions than those shown.

Figure 15A:
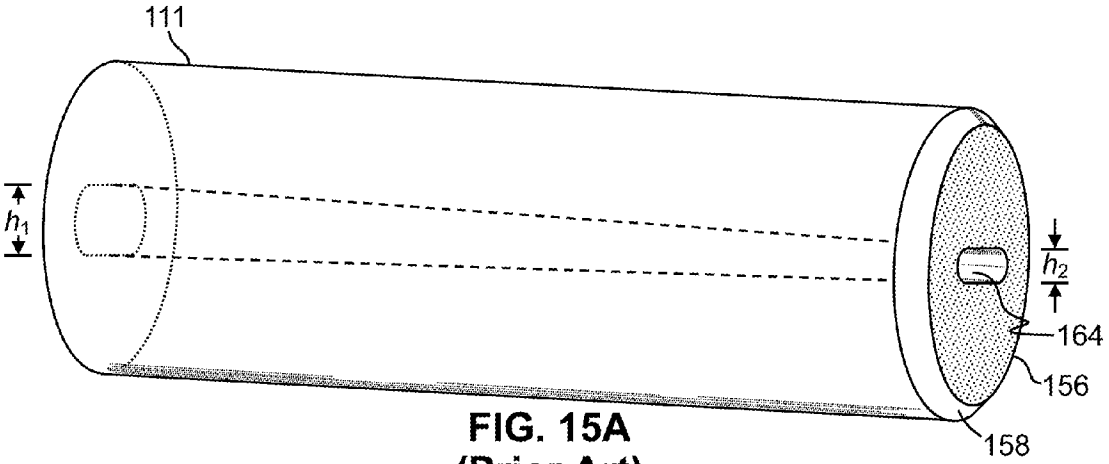
FIG. 15A (Prior Art)
FIG. 15A is a perspective view of a third ion transfer tube as may be employed in accordance with various embodiments of the instant teachings.

FIG. 15A illustrates an ion transfer tube having a slotted bore having at least one inner dimension that decreases in the direction of flow of charged particles through the tube. As a result, the cross-sectional area of the bore decreases in the same direction. The ion transfer tube 111 shown in FIG. 15A comprises a single bore 164 whose bore height, decreases from $h_1$ to $h_2$ in the flow direction from left to right. Alternatively, the width of the bore could decrease or both the height and width could decrease. As ions or other charged particles together with entrained sheath gas travel along the bore, the average flow velocity increases as the bore cross sectional area decreases and, consequently, the flow regime tends to become laminar flow. The high ion velocity and laminar flow regime downstream tends to minimize any potential adverse effects of increasing ion space charge, tube wall charging (in the case of dielectric materials) or ion discharging against the walls (in the case of electrically conductive wall materials).

Figure 15B:
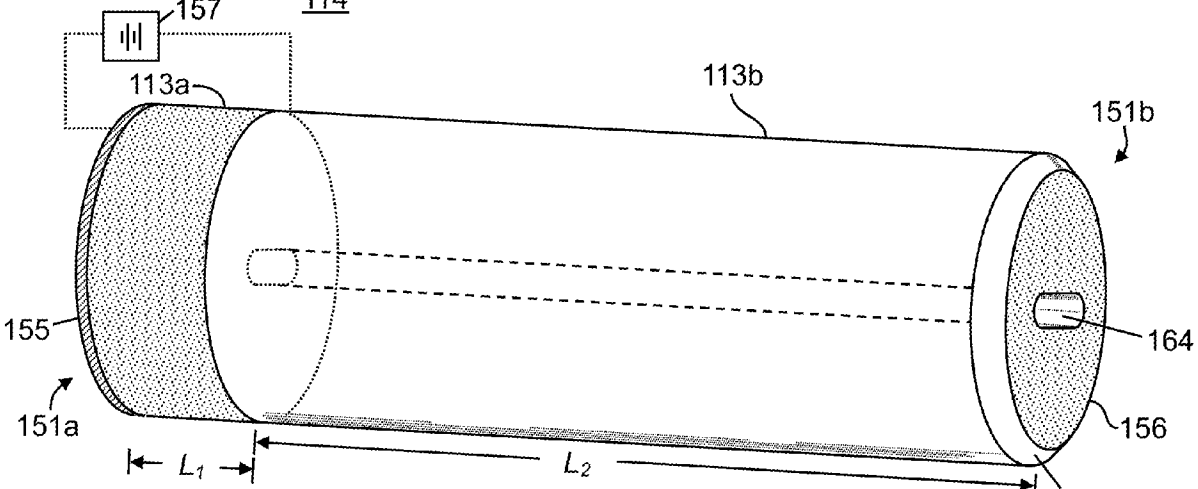
FIG. 15B (Prior Art)
FIG. 15B is a perspective view of another ion transfer tube as may be employed in accordance with the present teachings.

FIG. 15B is a perspective view of another ion transfer tube, ion transfer tube 114, as may be employed in systems in accordance with the present teachings. In contrast to the previously illustrated ion transfer tubes, the ion transfer tube 114 depicted in FIG. 15B comprises two separate structural members—a first tube member 113*a* formed of an electrically resistive material and a second tube member 113*b* formed of a material, such as a metal, that is an electrical conductor and that also has high thermal conductivity. The two tube members 113*a*, 113*b* are joined to one another by a leak-tight seal between the two tube members. Each of the tube members 113*a*, 113*b* has a bore. The two bores mate with one another—that is, comprise similar shapes and dimensions—at the juncture of the two tube members.

The flow within the ion transfer tube 114 is in the direction from the first tube member 113*a* to the second tube member 113*b*. Thus, the first tube member 113*a* and second tube member 113*b* are respectively disposed at the ion inlet end 151*a* and the ion outlet end 151*b* of the ion transfer tube 114. The distance from the open ion inlet of the ion transfer tube 114 to the contact between the first and second tube members 113*a*, 113*b* is represented as a length $L_1$ which is greater than or equal to a flow transition length. The flow transition length is the distance within which the through-going flow of carrier gas changes from an initial plug flow or turbulent flow to laminar flow. The second tube member 113*b* has a length $L_2$.

The resistive tube member 113*a* may be formed of any one of a number of materials (e.g., without limitation, doped glasses, cermets, polymers, etc.) having electrically resistive properties. It has been postulated (see Verbeck et al., US Patent Application Publication 2006/0273251) that the use of a tube comprising a resistive material enables the bleeding off of any surface charge that would otherwise accumulate on an electrically insulating tube as a result of ion impingement on the tube surface. An electrode 155, which may be a plate, a foil, or a thin film coating, is in electrical contact with an end of the first tube member. A power supply 157 whose leads are electrically connected to the electrode 155 and to the second tube member 113*b* is operable so as to provide an electrical potential difference between the electrode 155 and the second tube member 113*b*. Alternatively, the end of the first tube member 113*a* that faces the second tube member 113*b* may be provided with an electrode plate or film, such as a metalized coating together with a tab in electrical contact with the metalized coating. In such an instance, an electrical lead of the power supply 157 may be contacted to the tab, electrode plate or film, instead of directly to the second tube member.

As noted above, the length $L_1$ of the first tube member 113*a* should be at least as great as the distance required for the carrier gas flow to transition from an initial plug flow or turbulent flow to laminar flow. Within this flow-transition region, collisions of ions or other charged particles with the lumen wall are minimized by the axial electric field provided by the electrical potential difference between the electrode 155 and the second tube member 113*b*. Since the first tube member 113*a* is not an electrical insulator, those charged particles which may collide with the lumen wall do not cause surface charging of the first tube member and, thus, there is no opposing electrical field at the inlet end of the ion transfer tube 114 inhibiting the flow of charged particles into the tube. Once the ions or other charged particles have passed into the second tube member 113*b*, the laminar gas flow prevents further collisions with the lumen wall and, thus, a resistive tube material is no longer required. Instead, it is desirable to form the second tube member 113*b* of a sufficient length of a material with high thermal conductivity (such as a metal) such that ions are completely de-solvated by heat while traversing the second tube member 113*b*. This length required for desolvation, which may be on the order of several centimeters, may comprise a significant percentage of the space available for the ion transfer tube 114. Therefore, it may be desirable to limit the length $L_1$ of the first tube member 113*a*. The inventors have determined that adequate results are obtained when the length of the first tube member 113*a* (which may be substantially equal to $L_1$) is approximately 5 mm.

Figure 16A:
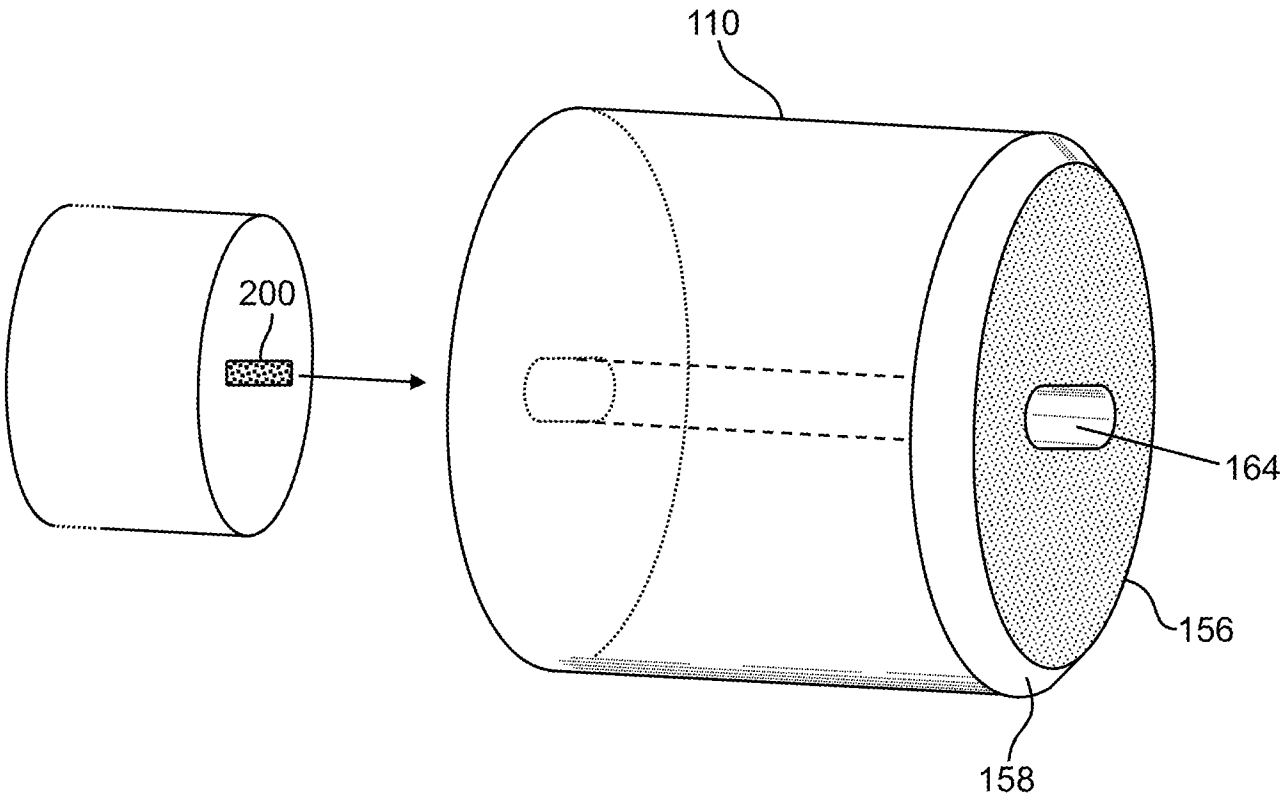
FIG. 16A (Prior Art)
FIG. 16A is an example, in perspective view, of an ion transfer tube fluidically coupled to and receiving charged particles from an ion emitter array.

The use of an ion transfer tube with a bore that has an elongated cross section such as a slot has the additional benefit (in addition to improved ion capture and desolvation) that it is a key element into implementing another technique that increases the sensitivity of a mass spectrometer: using arrays of electrospray emitters. Since the number of ions emitted by an array is increased with respect to that emitted by a single emitter, but the number of ions that can occupy the volume immediately in front of a conventional ion transfer tube is limited by Coulombic repulsion (the so-called space charge limit), the benefit of multiple emitters cannot be realized with a conventional ion transfer tube. FIG. 16A graphically illustrates this concept with reference to, for example, the ion transfer tube 110 for which a cross sectional view has already been provided in FIG. 10A. The elongate bore 164 may align with the long dimension of a linear array 200 of ion emitters, thereby decreasing space charge density at the tube entrance and geometrically providing a better match to the composite ion plume, both in comparison to a conventional ion transfer tube.

Figure 16B:
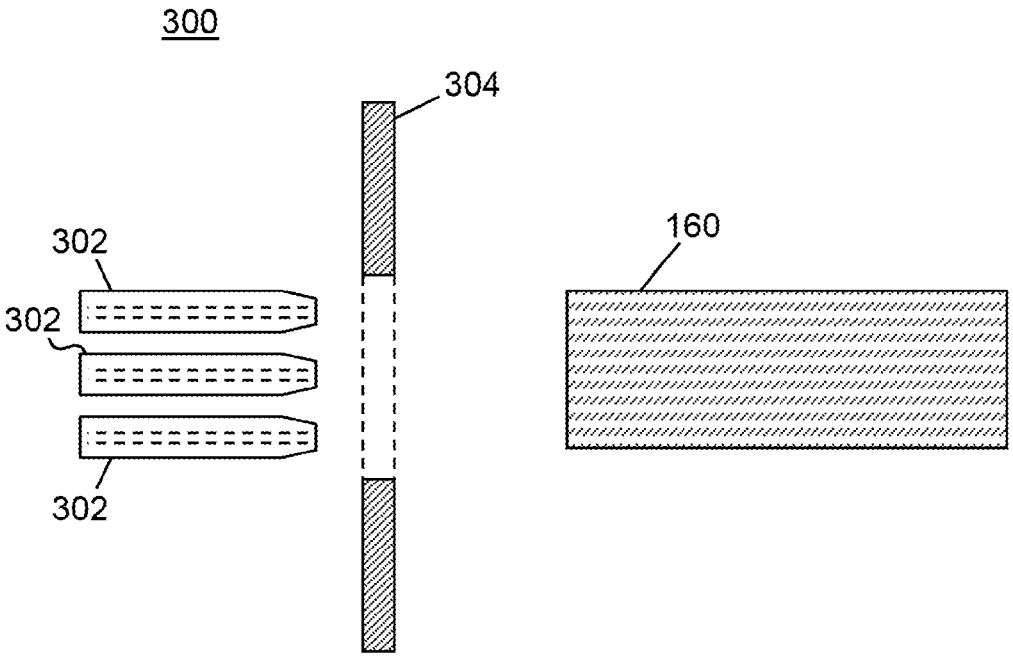
FIG. 16B (Prior Art)
FIG. 16B is a schematic illustration of an array of ion emitter capillaries fluidically coupled to a slotted ion transfer tube as may be employed in accordance with the present teachings.

The ion transfer tube 160 of the system 300 (FIG. 16B) may be employed in conjunction with and so as to receive ions from a variety ion emitter array configurations and a variety of ion emitter types. The generic ion transfer tube 160 represents any of the ion transfer tubes 110, 140, 111 and 114 described elsewhere in this document or, more generally, any ion transfer tube having a slotted or obround bore. The ion transfer tube 160 may be employed in conjunction with an emitter array or may be employed in conjunction with a single ion emitter of either conventional or novel design. As one example, FIG. 16B illustrates an array of conventional ion emitter capillaries 302 fluidically coupled to the ion transfer tube 160. The emitter capillaries may be configured so as to produce ions by either the electrospray or atmospheric pressure chemical ionization techniques. As is known, an extractor or counter electrode 304 may be disposed between the plurality of ion emitter capillaries and the ion transfer tube so as to provide an electrical potential difference the assists in accelerating charged particles towards the ion transfer tube 160.

In conclusion, the use of a system that includes an ion transport tube having at least one slotted or obround bore (e.g., a "letterbox" bore) that delivers ions to an ion funnel, stacked ring ion guide, or other multi-electrode ion transport device can not only enhance overall ion throughput into a mass spectrometer analyzer chamber but, also, can advantageously permit efficient exhausting of gas in intermediate chambers such that the greater throughput does not cause significant pressure increase in the analyzer chamber. Calculations and experimental observations indicate that the limited increase in the analyzer pressure, when compared to a round bore capillary at comparable throughput, is explained by the asymmetric expansion of gas exiting the slotted or obround bore. The asymmetric expansion effect is enhanced when the axis of the ion transfer tube is either offset from or at an angle to the axis of the ion transport device and the long dimension (corresponding to the width) of the bore is oriented within the plane of the two axes. When an ion transfer tube is employed in the configuration described above, this asymmetric expansion causes a radial dispersion of the gas streamlines away from the center axis of the ion transport devices, towards the edges of the RF electrodes, and reduces the flux of gas molecules going into the downstream pumping stages. By contrast, ions are focused towards an ion exit aperture along the axis of the device by action of electric fields applied to the electrodes.

Systems in accordance with the present teachings can include an ion transfer tube having a slotted or obround bore used in conjunction with a conventional ion funnel or a stacked ring ion guide. However, the asymmetric gas expansion effect may be used to even greater advantage when the slotted-bore ion transfer tube is used in conjunction with an ion transfer apparatus having an open design, as discussed herein, to aid in exhausting gas from the apparatus. It is found that the use of an ion transport system employing an ion transfer tube having a slotted or obround bore configured as described herein enables the use of a relatively short ion funnel (54 mm) in comparison to a system employing a conventional round-bore tube having the same cross sectional area. A further advantage of having a slotted-bore ion transfer tube is that the design of the slotted bores can aid in the de-solvation of ions passing through the ion transfer tube, particularly ions arising from a high aqueous liquid chromatography stream.

The discussion included in this application is intended to serve as a basic description. Although the invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the scope and essence of the invention. Neither the description nor the terminology is intended to limit the scope of the invention. Any patents, patent applications, patent application publications or other literature mentioned herein are hereby incorporated by reference herein in their respective entirety as if fully set forth herein.

What is claimed is:

1. A system for transporting ions from an ion source to an evacuated chamber of a mass spectrometer, the system comprising:

(a) an ion transfer tube having an axis, an inlet end configured to receive the ions and gas from the ion source, an outlet end and an internal bore between the inlet and outlet ends having a first dimension comprising a width and a second dimension comprising a height, the width being greater than the height;

(b) an apparatus comprising a plurality of electrodes, each electrode having a respective ion aperture having an aperture center, wherein the apertures define an ion channel configured to receive, at an inlet end of the apparatus, the ions from the outlet end of the ion transfer tube and to transport the ions therethrough to an outlet end of the apparatus, wherein the aperture centers define an axis of the ion channel and wherein at least a subset of the apertures progressively decrease in size in a direction towards the outlet end of the apparatus; and (c) a Radio Frequency (RF) power supply for providing RF voltages to the plurality of electrodes such that the RF phase applied to each electrode is different from the RF phase applied to any immediately adjacent electrodes, wherein the ion transfer tube is configured such that the ion transfer tube axis is non-coincident with the ion channel axis or such that the first dimension of the ion transfer tube bore is approximately parallel to a plane defined by the ion transfer tube axis and the ion channel axis.

2. A system as recited in claim 1, wherein the axis of the ion transfer tube is parallel to the axis of the ion channel and offset therefrom.

3. A system as recited in claim 1, wherein the axes of the ion transfer and of the apparatus are disposed at an angle, $\beta$, relative to one another, wherein $0° < \beta \leq 90°$.

4. A system as recited in claim 1, wherein the at least a subset of the apertures defines an ion funnel portion of the ion channel adjacent to the apparatus outlet, the ion funnel portion having a length that is less than a length of the ion channel, wherein the ion channel also includes a second portion disposed adjacent to the apparatus inlet comprising two or more of the apertures that are equal in size.

5. A system as recited in claim 1, wherein each of the plurality of electrodes is a ring electrode.

6. A system as recited in claim 5, wherein each ring electrode is supported on a respective one of a plurality of co-axial hollow tubes, each tube disposed parallel to the axis of the ion channel and formed of a non-electrically conducting material.

7. A system as recited in claim 5, wherein each ring electrode is supported by one or more spokes disposed non-parallel to the ion channel axis, each of the spokes having an end that is physically coupled to an external housing or supporting device.

8. A system as recited in claim 1, wherein the internal bore is one of two or more parallel slots.

9. A system as recited in claim 1, wherein at least one of the width or height of the internal bore of the ion transfer tube decreases through the ion transfer tube from the inlet end of the ion transfer tube to the outlet end of the ion transfer tube.

10. A system as recited in claim 1, wherein the first dimension of the ion transfer tube bore is substantially parallel to a plane defined by the ion transfer tube axis and the ion channel axis.

11. A method for transporting ions from an ion source to an evacuated chamber of a mass spectrometer comprising:

(i) providing an ion transfer tube having an axis, an inlet end configured to receive the ions and to receive gas from the ion source, an outlet end and an internal bore between the inlet and outlet ends having a first dimension comprising a width and a second dimension comprising a height, the width being greater than the height;

(ii) providing an ion transport apparatus comprising a plurality of electrodes, a plurality of surfaces of which comprise a plurality of non-co-planar rings defining a set of respective ion apertures whose diameters decrease along an axis of the ion transport apparatus from an ion input end to an ion exit aperture at an ion exit end, the set of ion apertures defining an ion channel through which the ions are transported to the evacuated chamber from the ion exit aperture; and (iii) providing RF voltages to the plurality of electrodes such that the RF phase applied to each electrode is different from the RF phase applied to any immediately adjacent electrodes, wherein the electrodes are disposed such that gaps are defined between each pair of successive electrodes, the gaps being oriented such that a gas flow input into the first end of the apparatus is exhausted through the gaps in one or more directions that are non-perpendicular to the axis, wherein the ion transfer tube is oriented, with respect to the apparatus, such that a primary zone of impingement of the gas upon the plurality of electrodes does not coincide or overlap with the ion exit aperture.

* * * * *